US005277680A

United States Patent [19]

Johnston

[11] Patent Number: 5,277,680

[45] Date of Patent: Jan. 11, 1994

[54] THERAPEUTIC LEVERAGING DEVICE

[75] Inventor: Thomas J. Johnston, Pittsford, N.Y.

[73] Assignee: Mechanical Advantage Ltd., Pittsford, N.Y.

[21] Appl. No.: 52,365

[22] Filed: Apr. 23, 1993

Related U.S. Application Data

[63] Continuation-in-part of Ser. No. 791,952, Nov. 13, 1991, which is a continuation-in-part of Ser. No. 638,074, Jan. 7, 1991, Pat. No. 5,076,576.

[51] Int. Cl.[5] ..... A63B 21/12

[52] U.S. Cl. ..... 482/95; 482/125; 482/907; 128/25 R

[58] Field of Search ..... 482/91, 92, 95, 79, 482/114, 115, 120, 139, 907, 125; 128/25 R; 25 B, 26 602/32, 36; 606/241

[56] References Cited

U.S. PATENT DOCUMENTS

| | | | |
|---|---|---|---|
| 2,183,265 | 12/1939 | Maloney | 482/95 |
| 3,117,782 | 1/1964 | Johnston | 482/95 |
| 3,999,752 | 12/1976 | Kupperman et al. | 482/139 X |
| 4,544,155 | 10/1985 | Wallenbrock et al. | 482/139 X |
| 5,057,709 | 11/1991 | Christianson | 482/95 |
| 5,176,377 | 1/1993 | Wilkinson | 482/114 X |

*Primary Examiner*—Richard J. Apley
*Assistant Examiner*—Linda C. M. Dvorak
*Attorney, Agent, or Firm*—Howard J. Greenwald

[57] ABSTRACT

An apparatus for flexing a foot of a human body, comprising means for grasping a foot, a first female buckle assembly, a second female buckle assembly, line cord, and ten separate means for guiding the line cord is disclosed. This apparatus allows a patient to rehabilitate an injured foot.

16 Claims, 16 Drawing Sheets

THERAPEUTIC LEVERAGING DEVICE

CROSS-REFERENCE TO RELATED PATENT APPLICATION

This application is a continuation-in-part of applicant's copending patent application U.S. Ser. No. 07/791,952, filed Nov. 13, 1991, which, in turn, was a continuation-in-part of U.S. Ser. No. 07/638,074, which was filed on Jan. 7, 1991, now U.S. Pat. No. 5,076,576.

FIELD OF THE INVENTION

A stretching device which may be used to flex and extend scar tissues is disclosed.

BACKGROUND OF THE INVENTION

Exercise devices which may be used to stretch scarred joints and connective tissue are well known to those skilled in the art.

By way of illustration, in 1961 Anthony Fuchs disclosed an excercising device which could be used for stretching a knee joint. In has U.S. Pat. No. 3,000,632, Fuchs disclosed a device comprised of a chair with a seat, a horizontally disposed transverse rod mounted adjacent to the seat, and a laterally extending rigid arm. The device of Fuchs appears to be relatively bulky, heavy, complicated, and expensive.

In 1978 Guido Koch disclosed a knee bending device in his U.S. Pat. No. 4,114,610. The device of this patent also is relatively bulky heavy, complicated, and expensive; it is comprised of a chair including a back support and arm rests, a hand-actuated, U-shaped, pivotally mounted stirrup with two substantially parallel limbs, and a connecting central bar.

In 1984, in his U.S. Pat. No. 4,463,947, Arthur Kloenne disclosed a knee and leg orthopedic exercising device The device of the Kloenne patent allegedly is ". . . capable of different degrees of participation or activity, depending upon the condition of the user (see column 1)." However, like the prior art devices discussed above, Kloenne's device is also rather complicated, bulky, and heavy. It is comprised of a chair, a wide leg rest with a vertical shank portion that is supported from a generally perpendicular crown portion, and a base portion comprised of roller means.

In 1985, in his U.S. Pat. No. 4,509,509, a reciprocating apparatus for treating human joints was disclosed by Jean Bouvet et al. This apparatus included an electrical stimulator, an electrically-actuated switch device, a control circuit, a pair of limit switches, a hydraulic cylinder, a base, roller means, and means for supporting one leg. In the operation of the rather complex device of this patent, once current flows to the device, a solenoid is activated, and a piston is caused to move within an air cylinder, thereby causing movement of the support means on which the patient's leg is mounted.

In 1986, in their U.S. Pat. No. 4,599,996, Nancy Seith and Robert C. Johnson disclosed an adjustable limb manipulating device. The device of this patent is comprised of a base adapted to be supported on the thigh of a patient's limb, an elongated extensible and retractable lever pivoted to the base, and a extensible and retractable lifter member having a stirrup portion. The device of this patent allows only a limited range of motion, does not provide any mechanical advantage to the user, and is not suitable for use by invalids who often do not possess a great deal of strength.

In 1987, in his U.S. Pat. No. 4,637,379, John H. Saringer disclosed a device for imparting continuous passive motion to a leg joint. The device of this patent contained an elongated base, a foot rest, a first member with a lower pivotal connection to traveling means, a second member, means for latching the first member to the second member, a spacing member, motor means, and control means. The device of this patent is complicated, cumbersome, and costly.

In 1988, in his U.S. Pat. No. 4,784,121, Lester N. Brooks discussed prior art devices which were adapted to articulate, or flex, a knee joint. At column 1 of his patent, Brooks noted that "A further class of exercisers provides upper body assistance, primarily through the user's arms in articulating the knee . . . U.S. Pat. Nos. 2,772,881—Fundom, 3,000,632—Fuchs and 4,114,610—Koch exemplify this class. The Fundom exerciser is relatively complicated. It has a further shortcoming in that flexion of the knee joint is not as fully controlled as would normally be desired. The Fuchs and Koch exercisers are incorporated into the structure of a chair . . .Although these devices provided the desired end of flexing a knee . . . , shortcomings still exist. . . The prior devices fail to provide a degree of control over leg movement which allows the user to determine the rate and extent of movement consistent with his tolerance to the pain involved, or with his desire to stress the leg muscles (see column 1 of the patent)."

Despite his recognition of the shortcomings of the prior art devices, the device disclosed in Brooks' United States patent also has substantial disadvantages. In the first place, it does not allow for full extension of the user's knee joint. In the second place, it has to be used in conjunction with a chair, thereby preventing the user from fully flexing the knee joint. In the third place, it does not provide mechanical advantage to the user, and thus cannot advantageously be used by invalids who might not possess a substantial amount of strength and endurance.

Another discussion of knee extending devices was presented in Stephen A. Rogers' U.S. Pat. No. 4,884,454 (1989). In this patent, Rogers notes that "A number of devices. . . have been proposed for use in facilitating knee and leg rehabilitation, some of such devices being disclosed in U.S. Pat. Nos. 4,114,610, 3,000,632, 4,463,947, 4,637,379, 4,509,509, and 4,599,996. Although some of the apparatus disclosed in these patents and elsewhere would apparently accomplish the desired knee and leg therapy and rehabilitation, such apparatus typically is also complicated in structure, cumbersome, and costly."

The device of the Rogers patent, notwithstanding Rogers' appreciation of the shortcomings of the prior art, is relatively expensive, fails to provide substantial mechanical advantage to the user, and is relatively cumbersome.

Thus, as least as late as 1989, the prior art did not provide a knee stretching device which was (1) allowed for full knee joint flexion, (2) allowed for full knee joint extension, (3) provides a substantial mechanical advantage to the user which may be maintained by him for relatively long periods of time (4) was relatively lightweight, (5) was simple in structure, (6) was easy to use, (7) was relatively inexpensive.

It is an object of this invention to provide an device for stretching scarred tissue or a damaged joint which allows the user to control the amount of force applied to the tissue or joint as well as the rate at which such force is applied.

It is another object of this invention to provide a device for stretching a knee joint or connective tissue which may be used in an environment containing a substantial amount of water (such as a whirlpool bath or a sauna) without substantial risk of deterioration of the device.

It is another object of this invention to provide a device for stretching a knee joint or connective tissue which is relatively inexpensive.

It is another object of this invention to provide a device for stretching a knee joint or connective tissue which is relatively lightweight, portable, and easy to use.

It is another object of this invention to provide a device for stretching a knee joint which allows the user to fully extend the knee joint.

It is another object of this invention to provide a device for stretching a knee joint or connective tissue which allows the user to fully flex his knee joint.

It is another object of this invention to provide a device for stretching a knee joint or damaged tissue which provides a substantial amount of mechanical advantage to the user so that one may stretch to the desired extent for a relatively long period of time.

It is another object of this invention to provide a device for stretching a knee joint or damaged tissue which is allows the user of the device to control the amount of stretch and, thereby, to minimize the amount of protective muscle guarding of the knee joint which will exist.

SUMMARY OF THE INVENTION

In accordance with this invention, there is provided self-actuated apparatus for the controlled flexing of a lower extremity, such as a knee joint. This apparatus is comprised of a flexion seat, an ankle cuff, a line cord, a first means for guiding the line cord, a second means for guiding the line cord, a third means for guiding the line cord, a fourth means for guiding the line cord, a fifth means of guiding the line cord, and a sixth means for guiding the line cord, a seventh means for guiding the line cord, and an eighth means for guiding the line cord.

BRIEF DESCRIPTION OF THE DRAWINGS

The present invention will be more fully described by reference to the following detailed description thereof, when read in connection with the attached drawings, wherein like reference numerals refer to like elements, and wherein.

DESCRIPTION OF THE PREFERRED EMBODIMENTS

Figure 1:
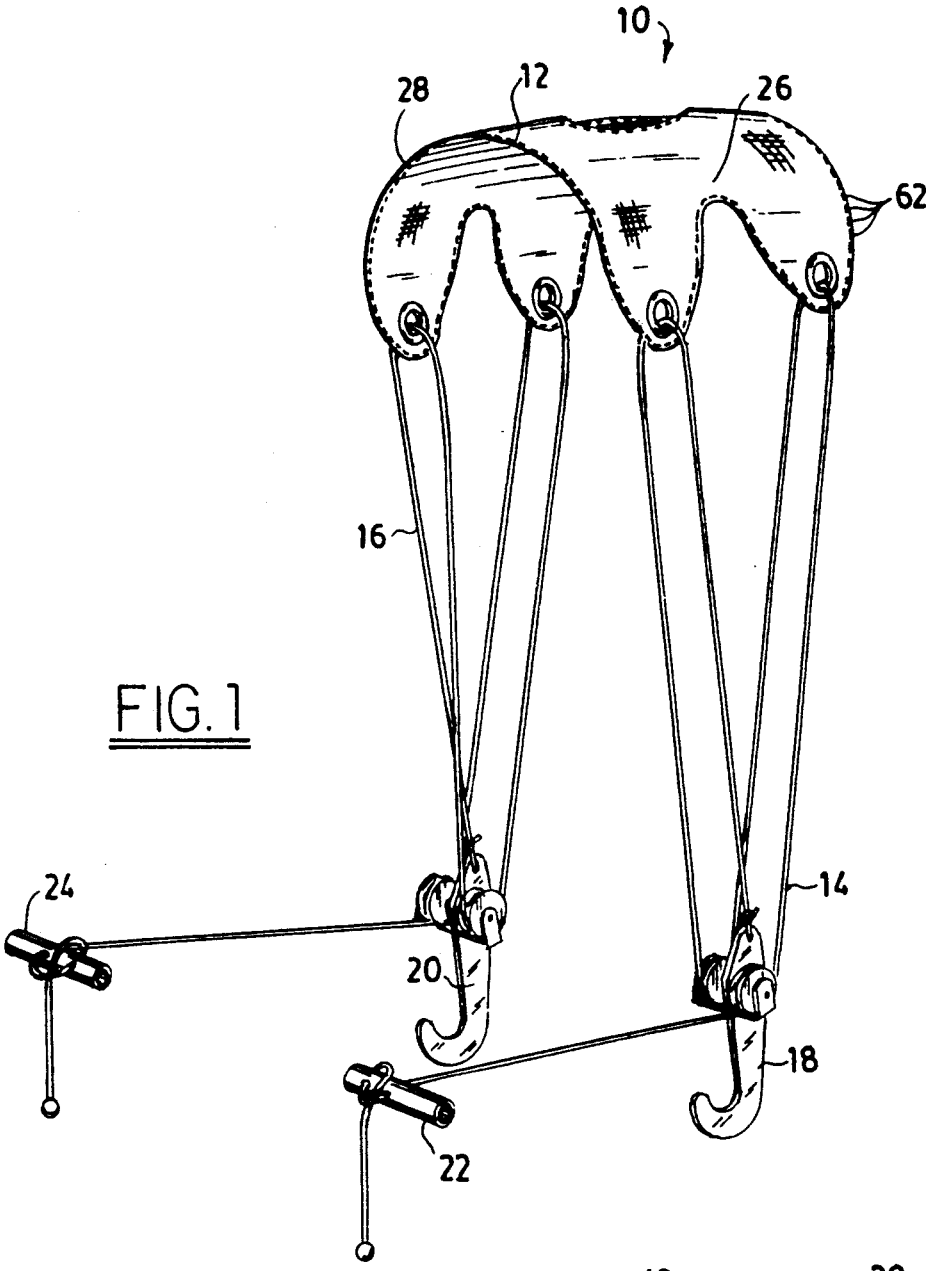
FIG. 1 is a perspective view of the apparatus of this invention.

One of the preferred embodiments of applicant's invention is illustrated in FIG. 1. Referring to FIG. 1, leveraging device 10 is comprised of harness 12, line 14, line 16, pulley system 18, pulley system 20, handle 22, and handle 24. As will be apparent to those skilled in the art, as handle 22 is moved, it causes line 14 to move the right half 26 of harness 12. By the same token, as handle 24 is moved, it causes line 16 to move the left half 28 of harness 12.

In the embodiment illustrated in FIG. 1, two separate handles (handles 22 and 24) are used. As will be apparent to those skilled in the art, one alternatively might use only one such handle with both of the lines 14 and 16 passing through it. Such handle, or such handles (in the embodiment where two such handles are used) may be equipped with a cord lock (not shown) which allows one to lock the cord in place after it has been pulled to a certain extent through the handle. One such cord lock which might be used is the "B-LOCK 5," which is manufactured by the ITW Nexus Company of Wood Dale, Ill. 60191.

As will be apparent to those skilled in the art, the embodiments of applicant's invention may be used to stretch and injured joint, such as a knee; and much of the description in this specification with regard to such embodiments discusses or illustrates the use of the embodiment to rehabilitate an injured knee. However, as is readily apparent to those skilled in the art, these embodiments also may be used to rehabilitate any injured portion of a patient's lower extremities, other damaged body parts (such as ankles, achilles tendons, calf muscles, and hamstring muscles), hip flexors, damaged connective tissue (such as burned skin), the neural-muscular system (with, e.g., stroke patients), any dysfunction that restricts a patient's range of motion with one or more of his lower extremities, and the like.

Figure 2A:
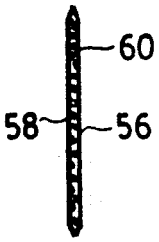
FIG. 2A is a side view of the harness of said apparatus.
Figure 2:
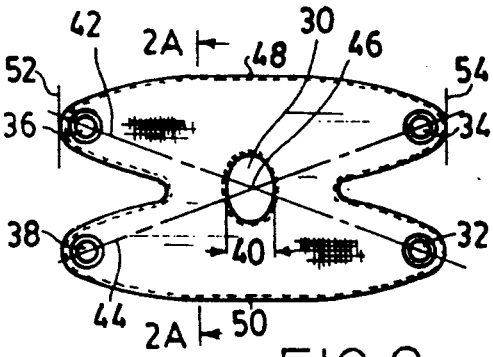
FIG. 2 is a top view of the harness of said apparatus.

FIG. 2 is a top view of the harness 12 shown in FIG. 1. Referring to FIG. 2, it will be seen that preferred harness 12 is an integral, flexible member comprised of at least one orifice and, preferably, at least five orifices such as orifices 30, 32, 34, 36, and 38.

Figure 5:
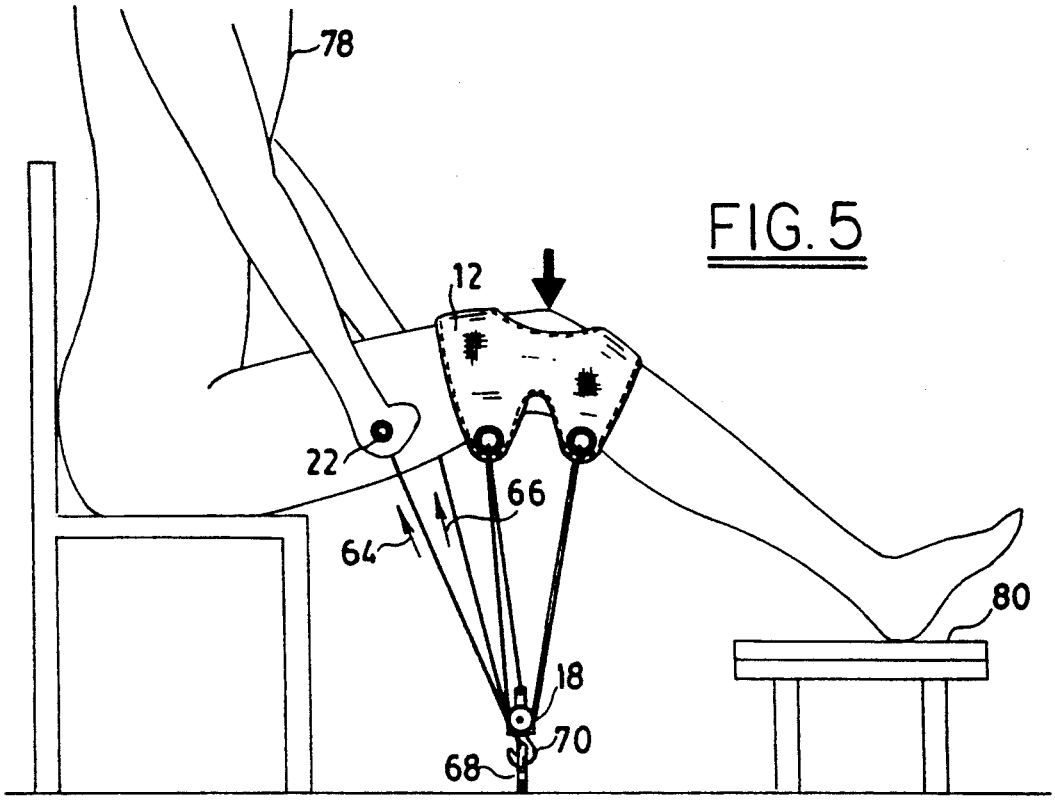
FIGS. 5 and 6 are operational views of the apparatus of FIG. 1.

Orifice 30 is the opening through which the patient's knee cap will extend (see FIG. 5). Orifice 30 may be of any shape such as, e.g., a circular shape, an oval shape, a rectangular shape, an irregular shape, etc. It is essential that the maximum dimension of orifice 30 be at least about 4 inches and, preferably, be from about 4 to about 7 inches. Furthermore, the width 40 of orifice 30 must be at least about 3 inches.

It is preferred that orifice 30 be substantially centered within harness 12. Thus, if a line 42 is drawn from the midpoint of orifice 34 to the midpoint of orifice 36, and another line 44 is drawn from the midpoint of orifice 32 to the midpoint of orifice 38, these lines 42 and 44 will intersect at a point 46 which is at the centerpoint of harness 12. The center of orifice 30 should substantially coincide with centerpoint 46.

The maximum width of harness 12 (i.e., the maximum dimension measured across the harness) may be measured from about point 48 to about point 50; and it must be at least about 10 inches and, preferably, must be from about 11 to about 16 inches.

The maximum length of harness 12 (i.e., the maximum dimension measured from the left side of the harness to the right side of the harness) may be measured from about point 52 to about point 54. The maximum length of harness 12 should be at least about 15 inches and, preferably, should be from about 19 to about 24 inches.

In addition to orifice 30, harness 12 also may comprise at least four additional orifices such as orifices 32, 34, 36, and 38.

At least two of the additional orifices should be located within the top 40 percent of the maximum width of harness 12. Thus, for example, if the maximum width of harness 12 is 10 inches (as measured from point 48 to point 50), then orifices 32 and 36 should appear within the top 4 inches of the maximum width. By the same token, at least two of the additional orifices should be located within the bottom 40 percent of the maximum width of harness 12 (such as, e.g., orifices 34 and 38).

At least two of the additional orifices (such as, e.g., orifices 36 and 38) should be located within the first 30 percent of the maximum length of harness 12, as measured from left to right (from point 52 to point 54). Thus, by way of illustration, if the maximum length (as measured from point 52 to point 54) is 20 inches, then orifices 36 and 38 should be located within an area no greater than about 6 inches from point 52 (as measured towards point 54). In one preferred embodiment, illustrated in FIG. 2, at least two of the additional orifices are located within the first 15 percent of the maximum length of harness 12, as measured from point 52 to point 54.

At least two of the additional orifices (such as, e.g., orifices 32 and 34) should be located within the last 30 percent of the maximum length of harness 12, as measured from right to left (from point 54 to point 52). Thus, by way of illustration, if the maximum length (as measured from point 54 to point 52) is 20 inches, then orifices 32 and 34 should be located within an area no greater than about 6 inches from point 54 (as measured towards point 52). In one preferred embodiment, illustrated in FIG. 2, at least two of the additional orifices are located within the first 15 percent of the maximum length of harness 12, as measured from point 54 to point 52.

In the preferred embodiment illustrated in FIGS. 1 and 2, each of additional orifices 32, 34, 36, and 38 is a grommet. As is known to those skilled in the art, a grommet is a reinforced orifice through which some material, like line 14, may be passed. The reinforcement may be a metal ring, e.g.

In one preferred embodiment, the reinforcement which is used to form grommets 32, 34, 36, and 38 is a two-piece ring comprised of interior plastic material and exterior metal alloy. These reinforcing rings are sold under the name of a "AB 20 stainless steel press ring" by the Bainbridge Aqua Battan Company of 252 Revere Street, Canton, Mass.

The reinforcing ring may be inserted into harness 12 by means well known to those skilled in the art. Thus, by way of illustration and not limitation, one may punch a hole in harness 12 with a die, position both halves of the reinforcing ring within a hydraulic ring press with the hole of the harness in the middle, and compress the reinforcing ring by the press to form the grommet.

It is preferred that the reinforcing ring(s) used in harness 12 to form grommets 32, 34, 36, and 38 be suited to impart a minimum amount of friction to line 24 and/or line 16. Those skilled in the sailboat rigging art are well aware of the existence of reinforcing rings which are specially designed to minimize friction between the surfaces of such rings and the lines which pass through them.

Referring to FIG. 2A, which is a cross-sectional view of harness 12, taken across lines 2A—2A of FIG. 2, it will be seen that integral harness 12 has a sandwich structure and is comprised of at least thee layers of material.

Referring again to FIG. 2A, it will be seen that harness 12 is comprised of at least two outer layers (such as outer layers 56 and 58) and at least one inner layer (such as, e.g., inner layer 60).

It is preferred to form harness 12 by positioning layers 56, 60 and 58 together and then joining them by suitable means known to those skilled in the art. Thus, e.g., such layers may be adhesively joined. Thus, for example, such layers may be sewn together. Thus, referring to FIGS. 1 and 2, it will be seen that layers 56, 60 and 58 are preferably held together by stitches of thread. As is known to those skilled in the art, the term thread refers to a fine cord of fibrous material which preferably is made of two or more filaments twisted together.

When layers 56, 60, and 58 are joined by sewing, it is preferred to use thread which is substantially waterproof. Thus, e.g., one may use a thread which consists essentially of a synthetic polymeric material.

One preferred thread which may be used to join together layers 56, 60, and 58 consists essentially of "DACRON." As is known to those skilled in the art, "DACRON" is a trademark owned by the E.I. duPont de Nemours and Company of Wilmington, Del. which describes a polyester fiber made from polyethylene terephthalate.

It is preferred that each of layers 56 and 58 be comprised of at least about 75 weight percent of a synthetic polymeric material such as, for example, nylon, polyester, polypropylene, and the like. A different synthetic polymeric material may be used in each of layers 56 and 58. In one embodiment, the same synthetic polymeric material is used in each of layers 56 and 58.

In one preferred embodiment, at least one of layers 56 and 58 is a coated fabric. As is well known to those skilled in the art, the desirable properties of a fabric can be supplemented by coating it with a polymer; see, e.g., pages 205-218 of J. L. Kroschwitz's "Polymers: fibers and Textiles, A Compendium" (John Wiley and Sons, New York, 1990), the disclosure of which is hereby incorporated by reference into this specification. In one preferred embodiment, at least one side of each of layer 56 and of layer 58 is coated with a polyurethane material.

In one preferred embodiment, at least about 75 weight percent of each of layers 56 and 58 is comprised of nylon. As is well known to those skilled in the art, nylon is a long chain polymeric amide. See, e.g., pages 552-554 of Henry R. Clauser's "Materials Handbook," Twelfth Edition (McGraw-Hill Book Company, New York, 1986), the disclosure of which is hereby incorporated by reference into this specification.

In one embodiment, each of layers 56 and 58 is made from a nylon fabric coated with a polyurethane material. In this embodiment, the nylon fabric preferably is "PARAPAC nylon pack cloth" obtainable from Astrup Distributors of 2937 West 25th Street, Cleveland, Ohio.

Referring again to FIG. 2A, in harness 12 layers 56 and 58 are preferably sewn together so that they form an interior cavity. It is preferred that substantially all of the space of such interior cavity be filled with foam material and that, thus, layer 60 consist essentially of foam.

As is known to those skilled in the art, foam materials are materials with a spongelike, cellular structure and include, e.g., polyurethane foams, sponge rubber, plastic foams, glass foams, refractory foams, metal foams, and the like. These foams, and other foam materials, are described on pages 329-331 of Henry R. Clauser's "Materials Handbook," supra.

In one preferred embodiment, the foam material used does not absorb water. Thus, by way of illustration, one may use celltight and gastight cellular rubber with a density of from about 3.5 to about 12 pounds per foot. Thus, e.g., one may use a foamed vinyl plastisol such as "ENSOLITE" (sold by Uniroyal, Inc. of Naugatuck, Conn.), "VINYLAIRE" (sold by Dura Flex Company), and the like.

In one preferred embodiment, the foam used in layer 60 is 0.25 inch thick, high-density "ENSOLITE" foam.

It is preferred that the total thickness of layers 56, 60, and 58 be from 0.125 to about 0.50 inches thick. It is even more preferred that the combined thickness of layers 56, 60, and 58 be from about 0.2 to about 0.4 inches.

In one preferred embodiment, the interior layer 60 consists essentially of fiberfill. As is known to those skilled in the art, fiberifll is a fiber designed specifically for use as a filling material in such products as pillows, comforters, quilted linings, and the like.

In one preferred embodiment, the interior layer 60 is comprised of cloth.

Referring again to FIG. 1, the leveraging device 10 of this invention is comprised of at least one line cord such as, e.g., line cord 14. The line cord used in the process of this invention is preferably similar to the line cord used in sailboat rigging and is well known to those skilled in the art. Thus, by way of illustration and not limitation, one may use any of the line cords described in the Summer, 1989 catalog of West Marine Products, P.0. Box 1020, Watsonville, Calif., the disclosure of which is hereby incorporated by reference into this specification.

It is preferred that the line cord used in the device of this invention have a diameter of from about 0.1 to about 0.5 inches and, preferably, from about 0.2 to about 0.4 inches. The line cord may consist essentially of a synthetic polymeric material such as "DACRON," and/or nylon, and/or "KEVLAR" (an aromatic polyamide fiber sold by the E.I. du Pont de Nemours and Company of Wilimington, Del.).

In one preferred embodiment, the line cord used is a woven polyester line with a diameter of about 0.16 inches which is sold by The Lehigh Group of Allentown, Pa.

In the preferred embodiment illustrated in FIG. 1, at least two line cords (cords 14 and 16) are used in applicant's leveraging device. Cord 14 passes through grommets 32 and 34 and through pulley system 18. Cord 16 passes through grommets 36 and 38 and through pulley system 20.

Figure 3:
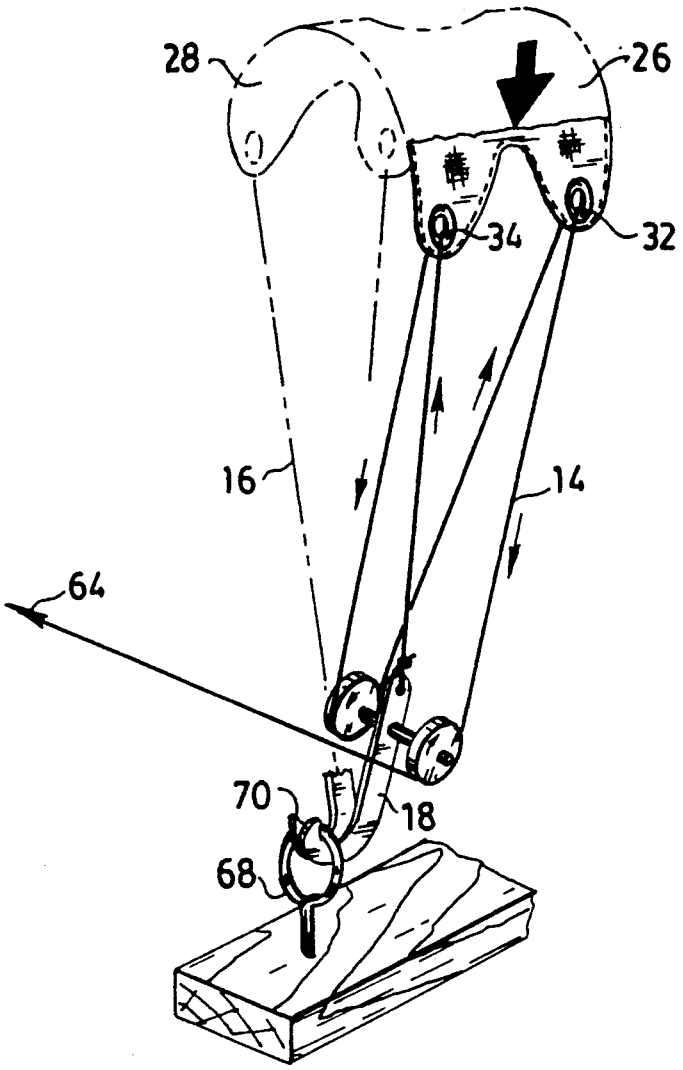
FIG. 3 is a partial operational view of the apparatus of FIG. 1, illustrating how it works when it is secured to surface.

FIG. 3 illustrates the direction of travel of line 14 when force is applied in the direction of arrow 64 by pulling on handle 22 (not shown). As line 14 is pulled in the direction of arrow 64, the system line 14 shortens, thereby pulling down the right half 26 of harness 12. By the same token, when line 16 (not shown in FIG. 3) is pulled in away from pulley assembly 20 (not shown), the left half 28 of harness 12 is pulled down. Thus, as handles 22 and 24 are pulled, both halves 26 and 28 of harness 12 are pulled down simultaneously.

Any suitable pulley assembly may be used in applicant's leveraging device 10. As used in this specification, the term pulley assembly refers to device comprised of securing means (such as hook 70) and at least two pulley wheels operatively connected to hook 70). This assembly is often referred to as a "pulley hook" and may be purchased, e.g., from Windsurfing Hawaii, Inc. of Post Office Box 765, Stevenson, Wash. 98648 as part number 01405.

In one embodiment, not shown in FIG. 3, line 14, after it is passed around the pulley hook, is passed again through grommet 34 and then to a handle (not shown in FIG. 1).

In the embodiment illustrated in FIG. 1, two hooks are shown connected to eyebolt 68. In another embodiment, not shown, a separate eyebolt is provided for each hook.

Figure 4A:
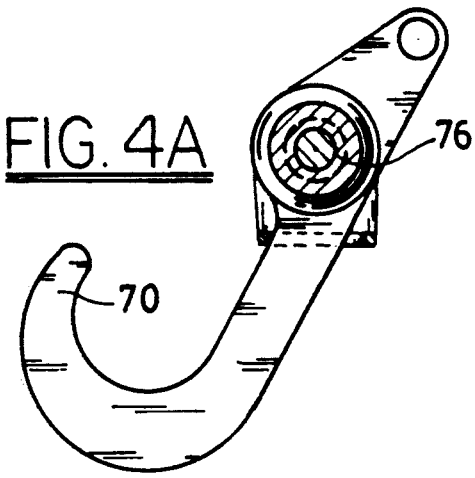
FIG. 4A is a side view of a pulley hook used in the apparatus of FIG. 1.
Figure 4:
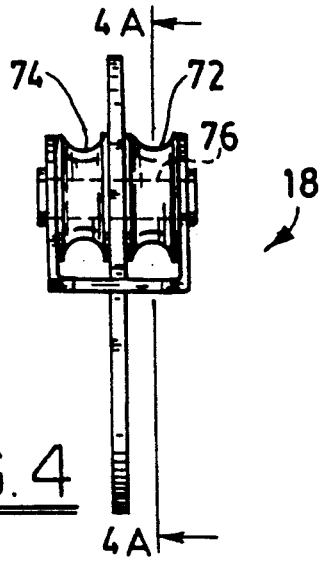
FIG. 4 is a front view of a preferred pulley used in the apparatus of FIG. 1.

FIG. 4 is a partial front view of pulley system 18. In the preferred embodiment shown in FIG. 4, it will be seen that pulley system 18 is comprised of pulley wheels 72 and 74 mounted on shaft 76. In another embodiment, not shown, pulley assembly 18 contains six pulleys.

It will be appreciated that the leveraging apparatus 10 of this invention preferably contains from about 1 to about 2 pulley hooks 70 and from about 2 to about 6 pulley wheels.

FIG. 4A is a side view of pulley assembly 18.

It is preferred that pulley assembly 18 and/or pulley assembly 20 be constructed of materials such that they will not be corroded by water. Thus, by way of illustration, each of said pulley assemblies is comprised of stainless steel.

Figure 6:
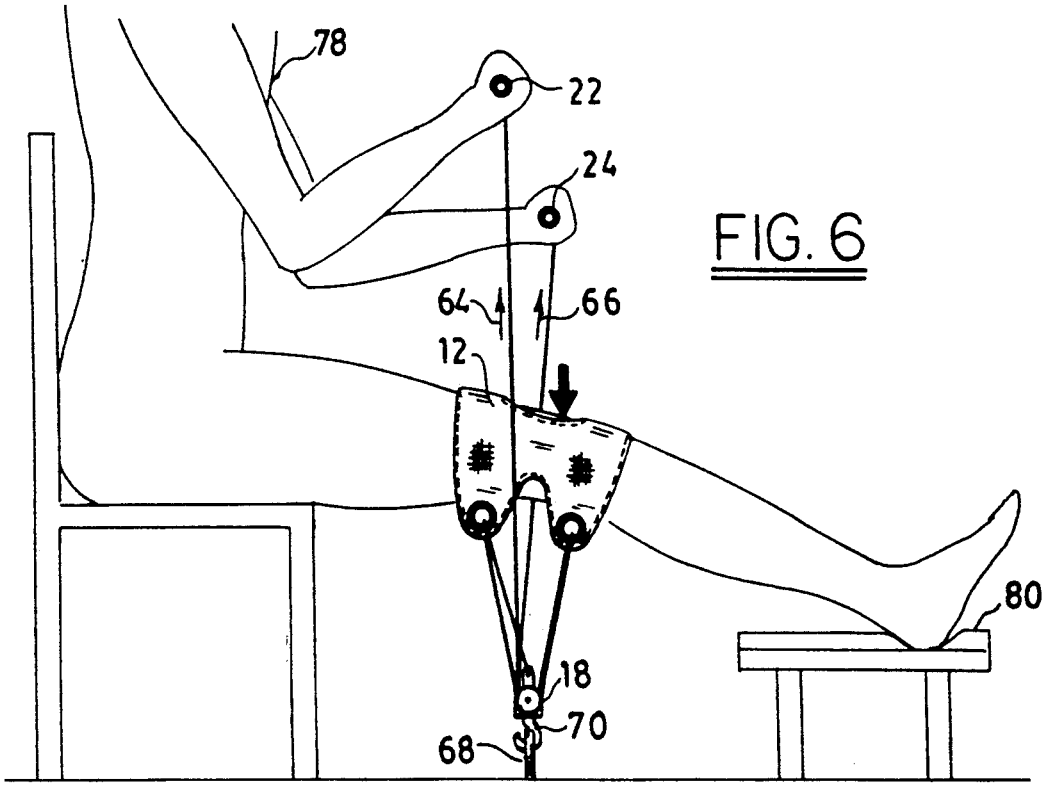

FIGS. 5 and 6 illustrate the leveraging device of this invention in use by a patient 78. Referring to these Figures, it will be seen that, as handles 22 and 24 are pulled in the direction of arrows 64 and 66, the harness 12 is pulled down, thereby stretching the knee joint of patient 78.

In the embodiment illustrated in FIGS. 5 and 6, the chair and stool are shown resting upon a support surface, such as a floor. In another embodiment, not shown, a separate platform (which may be constructed, e.g., of plywood) is provided upon which the chair and stool may rest. This platform is also preferably comprised of a multiplicity of eyebolts (such as eyebolt 68).

In the process of this invention, it is preferred to rest the patient's leg upon some surface such as, e.g., stool 80. Thereafter, the patient may place harness 12 over his kneecap and secure each of hook pulley systems 18 and 20 into one or more screw eyes such as, e.g., screw eye 68. Once the leveraging device 10 has been secured, the patient 78 may then reach down and grasp the handles 22 and 24, pull backwards and upwards in the direction of his thigh, thereby pulling harness 12 down. Once harness 12 has been pulled down to the desired extent, the patient 78 may maintain the tension on such harness. One convenient means of so doing is to rest handles 22 and/or 24 against the patient's thigh and hold the handles in place there with one or both hands.

THE FLEXION HARNESS

The device 10 described in the first part of this specification is a leverage extension system for straightening a knee joint. The device described below is a leverage flexion system for flexing the knee joint.

The leverage flexion system is comprised of a seat harness and an ankle cuff.

Figure 7:
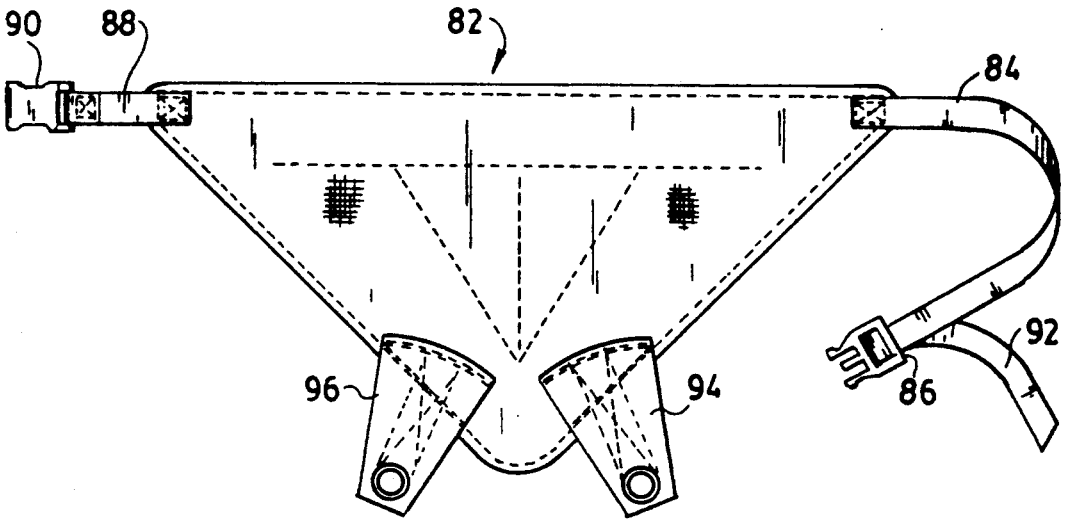
FIG. 7 is a front view of an unbuckled seat harness described in this specification.

Referring to FIG. 7, and to the preferred embodiment illustrated therein, seat harness 82 is comprised of a means for securing the harness to a patient's hips. These securing means comprise belt 84, fastener 86, belt 88, and fastener receptacle 90.

As will be apparent to those skilled in the art, other securing means also may be used. Thus, by way of illustration and not limitation, the belt 84/fastener 86/belt 88/receptacle 90 assembly may be replaced and/or supplemented by a substantially integral belt assembly (not shown) disposed within slots (not shown) or belt loops (not shown) within or on said harness 82. Other securing means will be readily apparent to those skilled in the art.

Referring again to the embodiment depicted in FIG. 7, any of the fasteners and/or fastener receptacles commonly used for securing nylon webbing may be used as elements 86 and/or 90. Thus, e.g., one may use the devices described in U.S. Pat. Nos. 4,150,464 and/or 4,171,555, the disclosures of which are hereby incorporated by reference into this specification.

In the preferred embodiment of FIG. 7, belt 84 is preferably secured to harness 82 by conventional means such as, e.g., sewing. This belt may comprise or consist of any belting material. One preferred belting material, which may be used for both belt 84 and belt 88, is nylon webbing material.

In such embodiment, the belt 84 is preferably attached to a fastener, such as fastener 86. Any of the belt fasteners which are known to those skilled in the art may be used as fastener 86. Thus, by way of illustration and not limitation, one may use a "FASTEX" buckle (which is manufactured by the Illinois Tool Works, and which is distributed by the Liberty Mountain Sport Corporation of Liberty, Calif.).

Belt 88 is also attached to harness 82 by conventional means such as, e.g., by sewing. The end of belt 88 is preferably attached to a fastener receptacle 90 such as, e.g., a "FASTEX" receptacle (available from Tent City of Rochester, N.Y.).

Figure 8:
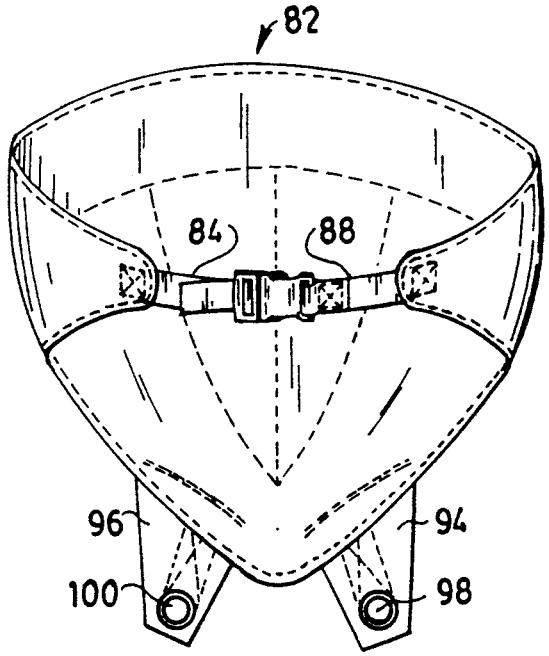
FIG. 8 is a front view of the seat harness of FIG. 7 when said harness is buckled.

As will be apparent to those skilled in the art, when buckle 86 is inserted into receptacle 90, and end 92 of belt 84 is tightened, harness 82 may be drawn around the hips of a patient (not shown); see, e.g., FIG. 8.

In the preferred embodiment illustrated in FIGS. 7 and 8, harness 82 is comprised of two downwardly-extending members, each of which is comprised of at least one orifice. Thus, in the preferred embodiment illustrated in FIGS. 7 and 8, harness 82 is comprised of wedge-shaped members 94 and 96. Each of members 94 and 96 is comprised of an orifice which, preferably is a grommet. Thus, e.g., grommets 98 and 100 exist within the lower portions of members 94 and 96, respectively.

As will be apparent to those skilled in the art, members 94 and 96 each may be comprised of a multiplicity of orifices. In one embodiment, not shown, each of members 94 and 96 is comprised of from about 2 to about 5 orifices (such as grommets); in one preferred aspect of this embodiment, each of members 94 and 96 is comprised of 4 grommets.

Referring again to the preferred embodiment illustrated in FIGS. 7 and 8, each of grommets 98 and 100 is adapted to cooperate with a hook (not shown) in order to removably attach an ankle cuff (see FIG. 11) to one of these grommets. It is preferred that each of grommets 98 and 100 be comprised of a reinforcing ring consisting essentially of nickel-plated bronze.

It will be appreciated by those skilled in the art that harness 82 provides a means of disposing at least one grommet at a point where a patient's hamstring joins his buttock. This grommet then may be connected to an ankle cuff, and thereafter a patient's leg may be fully flexed.

The harness 82 preferably has a sandwich-type structure similar in cross-section to the harness 12. Thus, such harness generally has a total thickness of from about 0.1 to about 0.5 inches and is comprised of at least two polymeric outer layers and at least one inner layer which, preferably, consists essentially of foam material.

Figure 9:
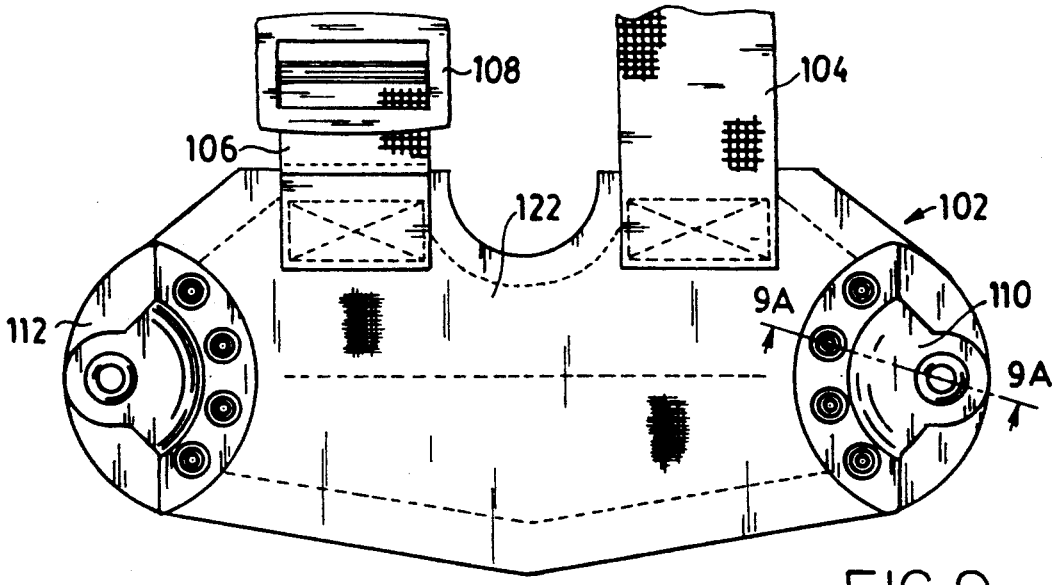
FIG. 9 is a front view of an ankle cuff described in this specification.
Figure 9A:
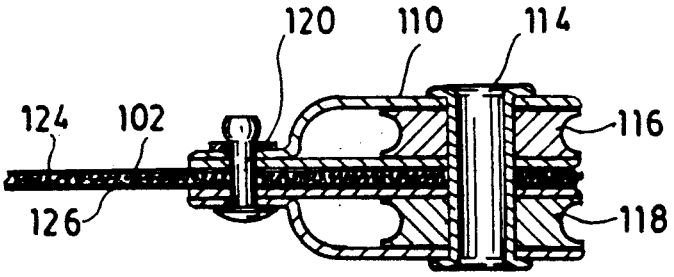
FIG. 9A is a partial sectional view of a pulley block disclosed in the embodiment of FIG. 9.
Figure 10:
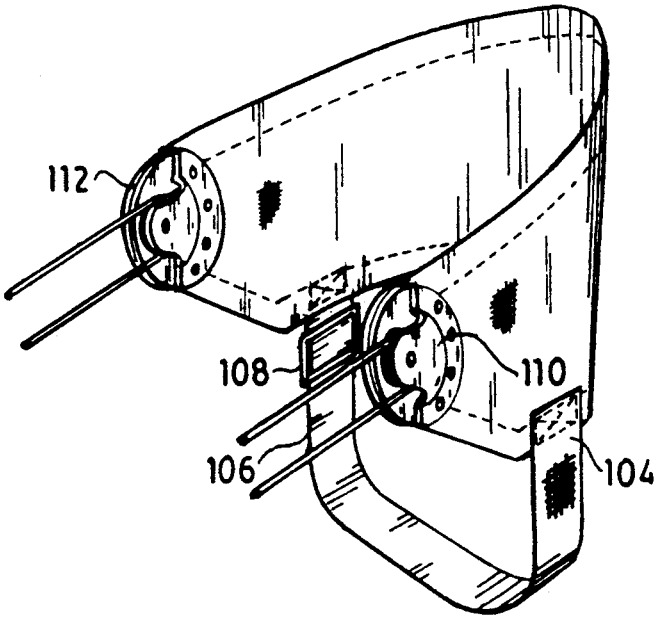
FIG. 10 is a side view of the ankle cuff of FIG. 9.

One of the ankle cuff's which may be used in applicant's flexion system is illustrated in FIGS. 9, 9A, and 10. Another of such cuff's is discussed elsewhere in this specification by reference to FIG. 15.

Referring to FIG. 9, it will be seen that ankle cuff 102 is preferably comprised of arch strap 104, arch strap 106, slide adjuster 108, pulley block 110, and pulley block 112. In one embodiment, not shown, a shin insert in attached to the ankle cuff 102 between straps 104 and 106 to afford a user extra padding on his shin; this shin insert may be attached by conventional means, such as sewing.

Referring to the preferred embodiment illustrated in FIGS. 9, 9A, and 10, the function of arch straps 104 and 106 is to position the pulley blocks 110 and 112 above the ankle bones of a patient (not shown). The arch straps 106 and 106 shown in this embodiment are adapted to each be secured by a buckle; in another embodiment, not shown, the arch straps are secured with both buckles and "VELCRO" loop and hook fabric securing means.

Referring again to the embodiment illustrated in FIGS. 9 and 9A, any of the pulley blocks known to those skilled in the art may be used in applicant's invention. Thus, FIG. 9A is a cross-sectional view of the preferred pulley block illustrated in FIG. 9.

Referring to FIG. 9A, it will be seen that pulley block 110 is comprised of axle rivet 114 and, disposed on said axle rivet, pulley wheels 116 and 118. Aluminum rivet 120 secures pulley block 110 to the ankle cuff 102.

In one preferred embodiment, pulley block 110 is made from two separate members each of which are riveted to the ankle cuff 102 to form the pulley block. Thus, e.g., each of the separate members may be one half of a a two-piece Clew End Pulley Block (available from Bainbridge Aqua Batten Company as part number 128). Each half of this pulley block is attached to an integral ankle-cuff assembly 122.

As will be seen from cross-sectional view 9A, and in the preferred embodiment illustrated therein, integral ankle cuff assembly member 122 is a flexible sandwich-like structure comprised of at least two outer polymeric layers 124 and 126 (such as the nylon material described elsewhere in this specification) and at least one inner foam layer 128 (such as the "ENSOLITE" foam material described elsewhere in this specification). The belting materials 104 and 106 are preferably sewn to assembly member 122. Assembly member 122 has a thickness of from about 0.125 to about 0.5 inches.

A line is passed through each of pulley blocks 110 and 112 and is connected to a pulley hook which is attached to either of grommets 98 or 100.

Figure 11:
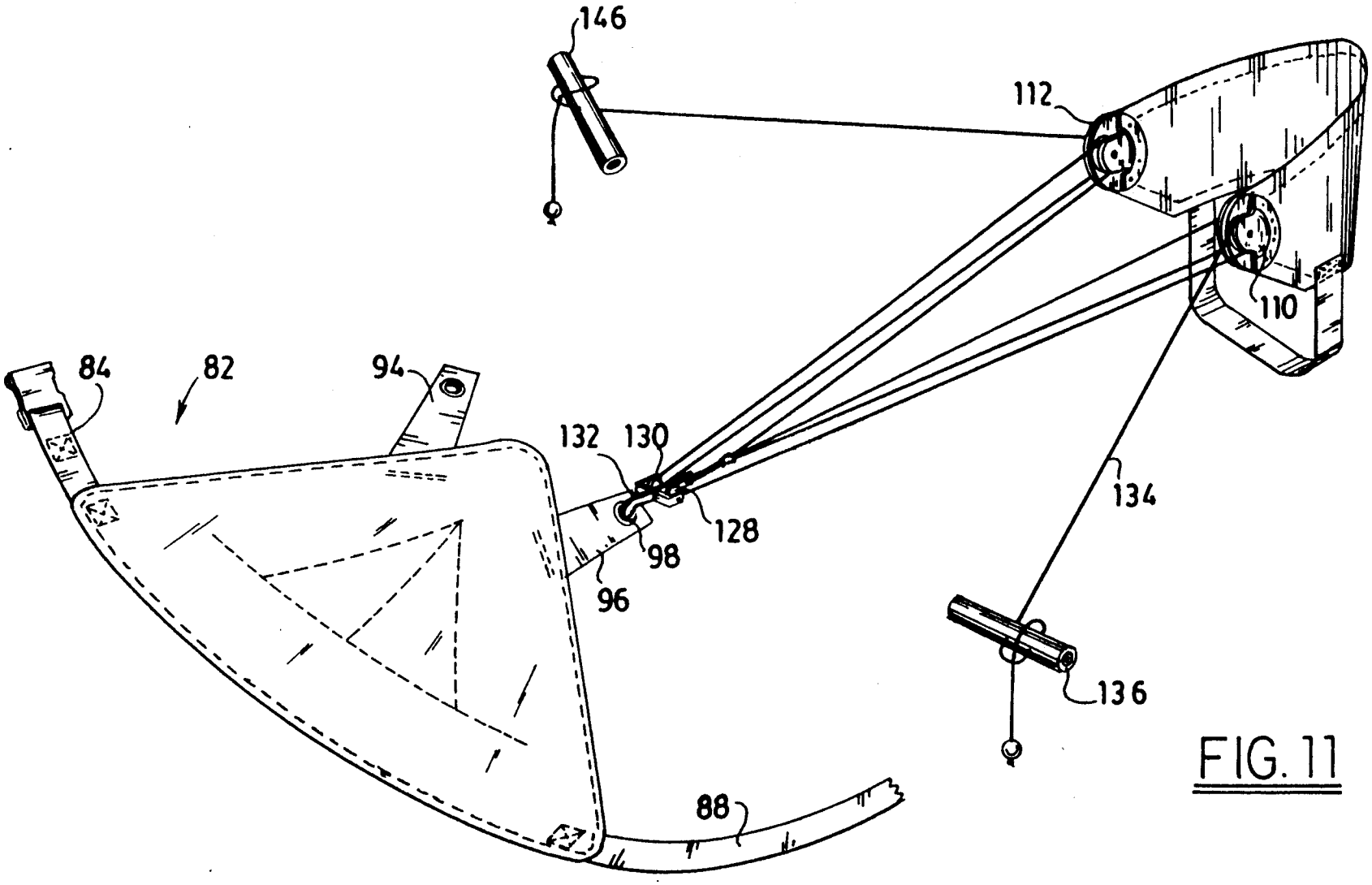
FIG. 11 is an operational view of the ankle cuff/seat harness system of FIGS. 9 and 7.

The operation of this flexion device is illustrated in FIG. 11. As was mentioned elsewhere in this specification, one may modify the configuration depicted in FIG. 11 by using only one handle (rather than two) and employing a cord lock (such as "B-LOCK 5") rather than tying the line cord around the handle(s).

Figure 12:
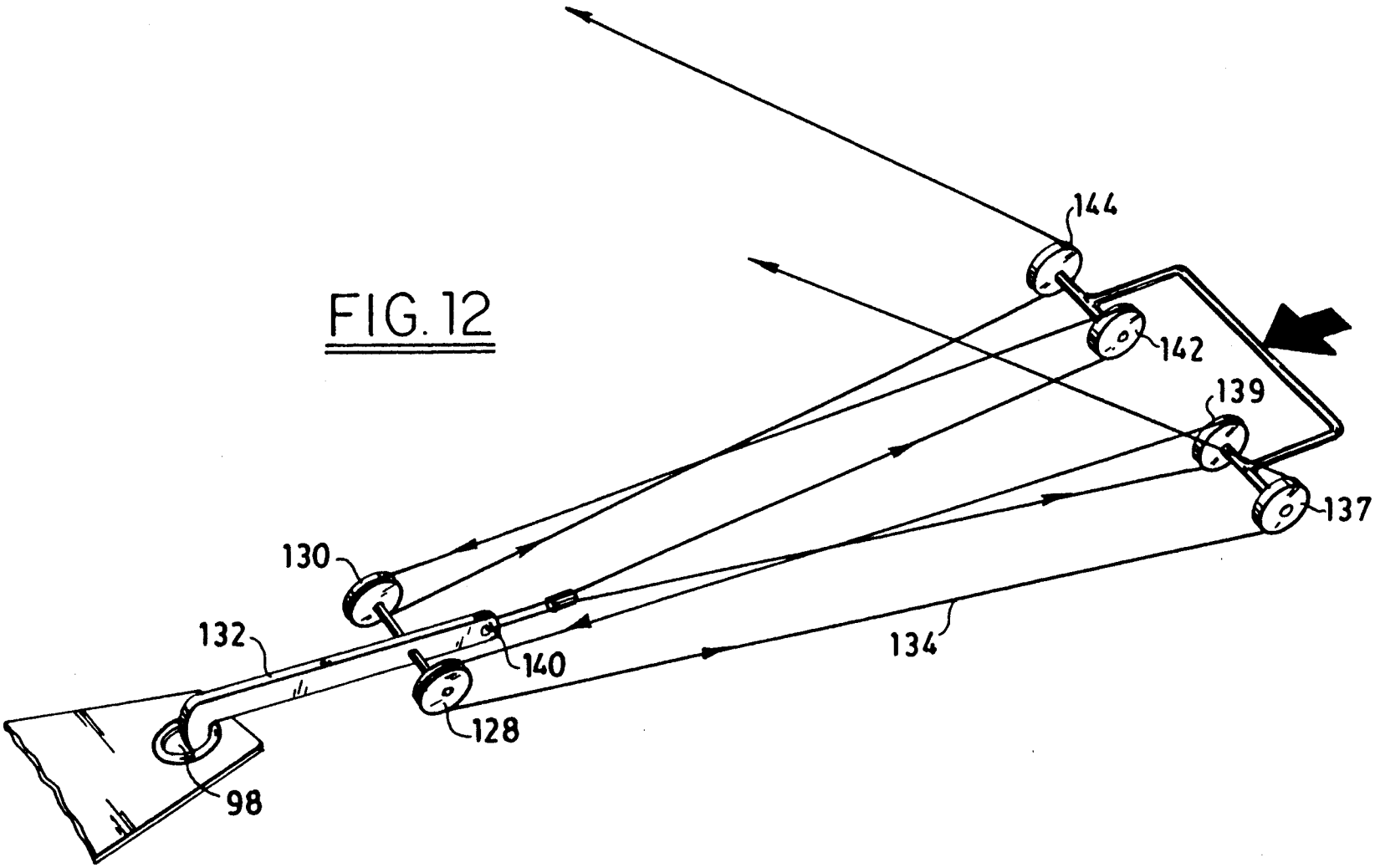
FIG. 12 is a another operational view of the system of FIG. 11, showing how the line used in said system travels.

Referring again to FIGS. 11 and 12, and in the preferred embodiment illustrated therein, pulley wheels 128 and 130 are connected via pulley hook 132 to grommet 98. Thereafter, a line 134 is passed through handle 136, and then around the outer pulley wheel 137 of pulley block 110, and then around pulley wheel 128, and then around the inner pulley wheel 139 of pulley block 110, and then through hole 140, and then around inner pulley wheel 142, and then around pulley wheel 130, and then around outer pulley wheel 144, and then connected to handle 146.

Figure 13:
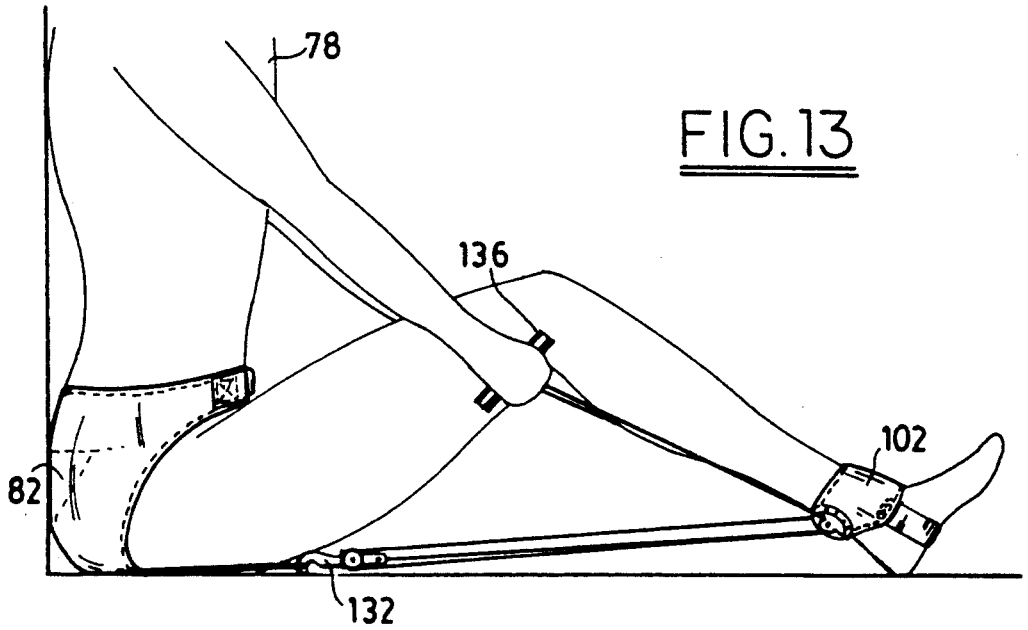
FIGS. 13 and 14 illustrate the system of FIG. 11 being used by a patient.
Figure 14:
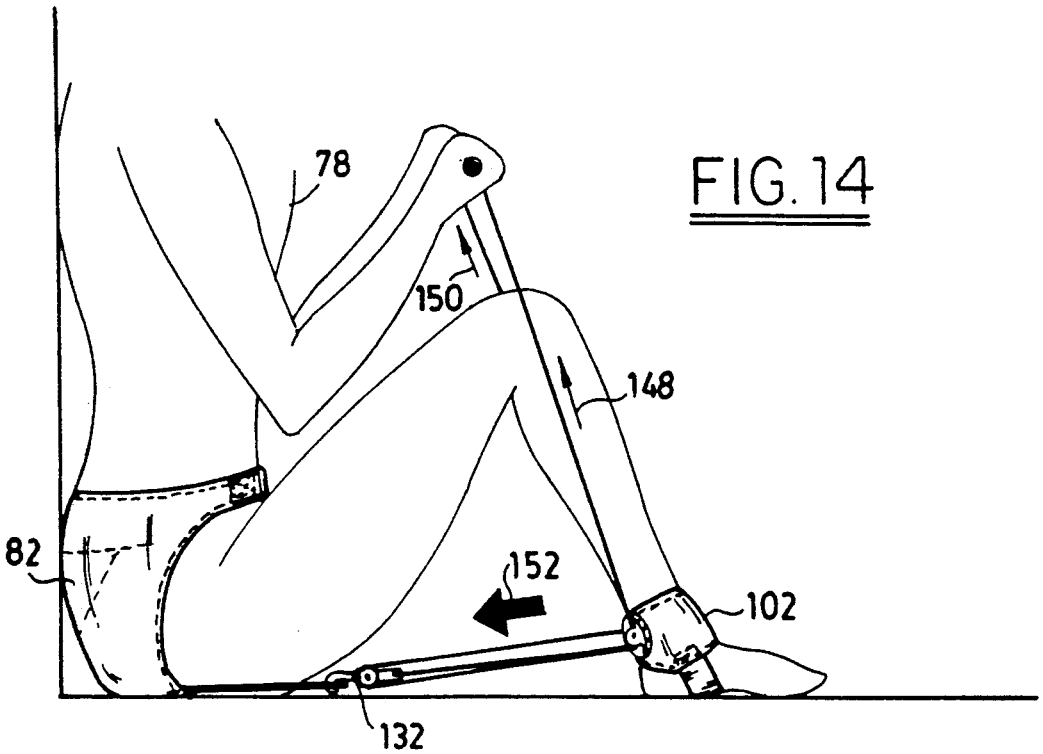

As is illustrated in FIGS. 13 and 14, seat harness 82 may be attached around the waist of the patient 78, and the ankle cuff 102 may be attached on the ankle of the injured leg. Alternatively, the ankle cuff illustrated in FIG. 15 may be used in place of ankle cuff 102.

Referring again to FIGS. 13 and 14, the pulley hook 132 is then attached to the grommet corresponding to the injured leg (either grommet 98 or 100), and the handles 136 and 146(not shown) may then be pulled in the direction of arrows 148 and 150, thereby pulling ankle cuff 102 in the direction of arrow 152 towards the patients hips. As will be apparent to those skilled in the art, the more force which is exerted in the direction of arrows 148 and 150, the more the patient's knee is flexed.

Figure 15:
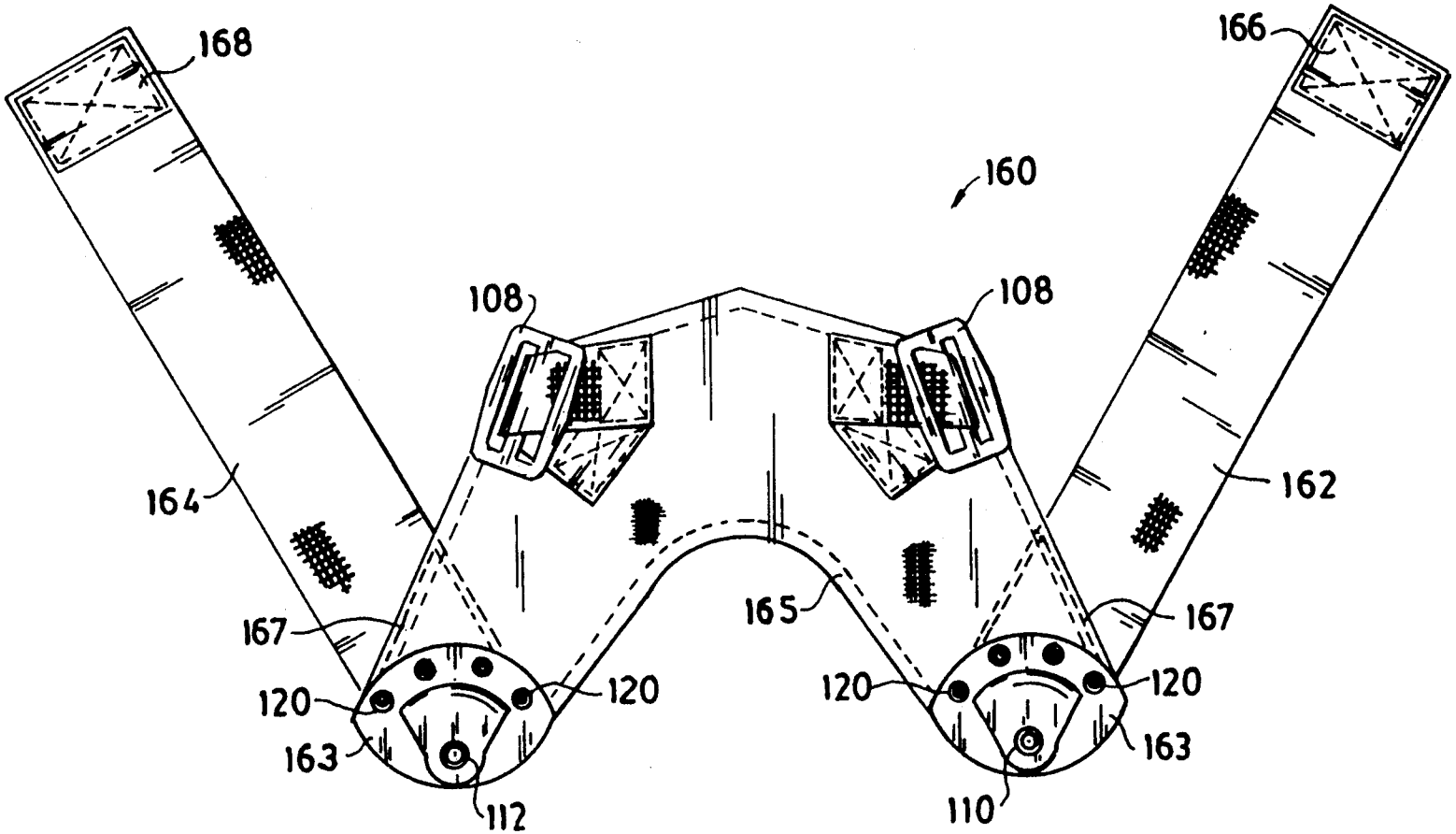
FIG. 15 is a top view of a preferred embodiment of an ankle cuff which may be used in one of the devices of this invention.

Another preferred ankle cuff which may be used in the flexion device of applicant's invention (see FIG. 14) is illustrated in FIG. 15. Referring to FIG. 15, it will be seen that ankle cuff 160 is similar in many respects to the ankle cuff 102 illustrated in FIG. 9, but it has a different shape and, furthermore, its arch straps 162 and 164 are attached in a different manner than the straps 104 and 108 of the embodiment of FIG. 9. In the embodiment of this FIG. 15, the pulley blocks 110 and 112 are attached to arch straps 162 and 164, respectively. A sanwich structure is formed by the outside surface 163 of the pulley blocks 110 and 112, the arch straps 162 and 164, and the top surface 165 of the ankle cuff 160, which are all secured together by stitches 167 and by rivets 120 Furthermore, in this embodiment, it will be seen that arch straps 162 and 164 preferably are comprised of areas 166 and 168 of complementary "VELCRO" fabric so that areas 166 and 168 may be removably attached to each other.

It is preferred that, except for the differences described above, ankle cuff 160 be constructed in a manner substantially identical to that of ankle cuff 102. Thus, by way of illustration and not limitation, both of such ankle cuffs will be comprised of a flexible sandwich-like structure comprised of at least two outer polymeric layers and at least one inner foam layer, each of which is described in detail elsewhere in this specification.

In one preferred embodiment, not shown, the two seaprate buckles 108/webbing assemblies are replaced by a single, continuous piece of nylon webbing which is attached to the body of the cuff by conventional means (such as by sewing) in its middle portion and is attached at each of its end portions to a separate buckle 108 assembly.

In another preferred embodiment, not shown, a shin insert (not shown) is inserted in the substantially U-shaped area between the pulley blocks to afford more padding for the patient's shin and is attached to the body of the cuff by conventional means.

Figure 16:
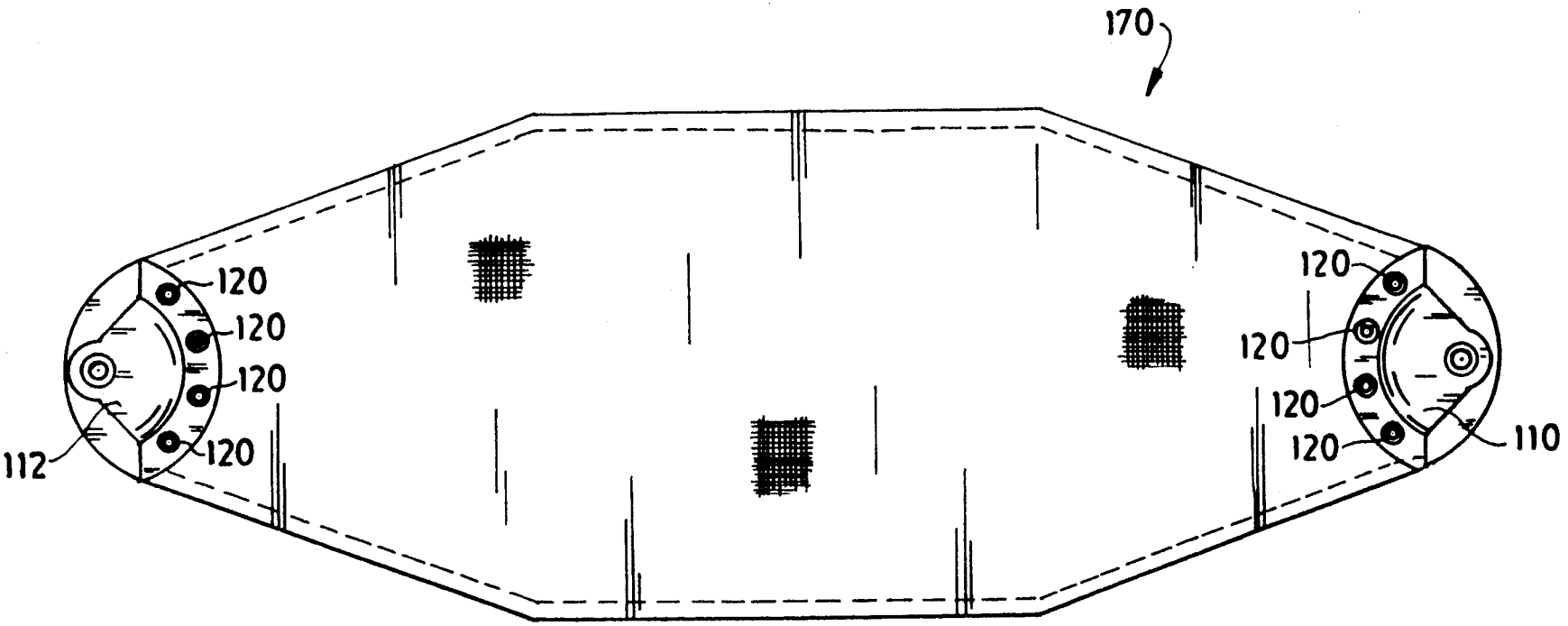
FIG. 16 is a top view of a preferred embodiment of a block strap which may be used in one of the devices of this invention.
Figure 17:
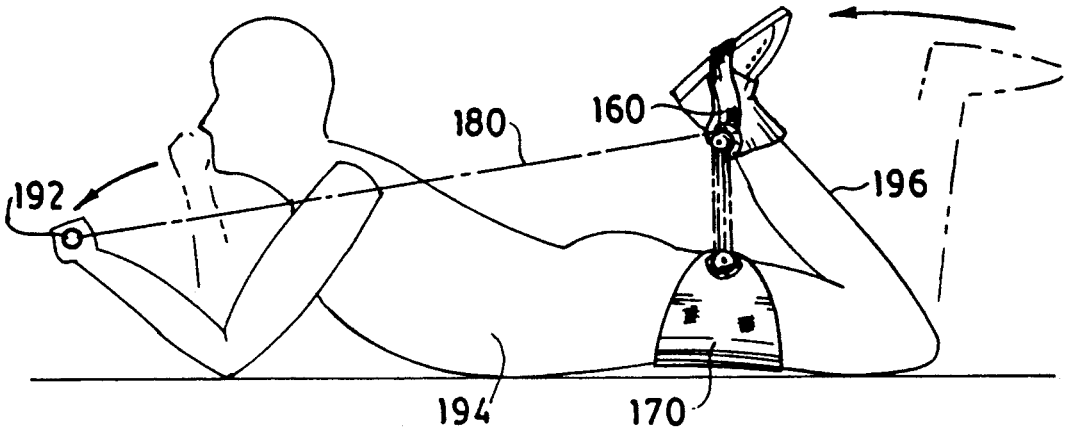
FIG. 17 is an illustration of one means of using a particular flexion device of this invention.
Figure 18:
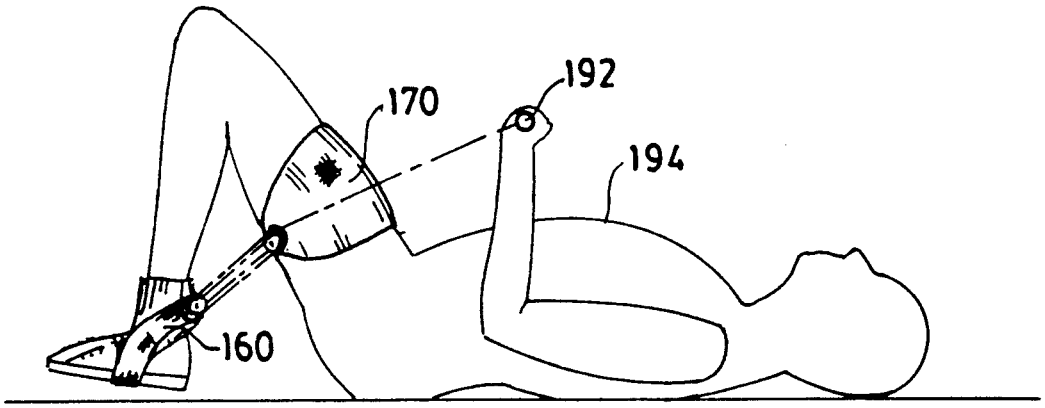
FIG. 18 is an illustration of another means of using the flexion device of FIG. 17.

FIG. 16 is a top view of one preferred a block strap 170 which may be used in the device illustrated in FIGS. 17 and 18. Referring to FIG. 16, it will be seen that block strap 170 is also comprised of pulley blocks 110 and 112. Block strap 170 preferably has the same flexible sandwichlike structure comprised of at least two outer polymeric layers and at least one inner foam layer which is described above.

In one embodiment, not shown, a web of reinforcing fabric is sewn to the ends of the block strap prior to the time the pulley blocks are attached. The use of the reinforcing material strengthens the assembly.

Figure 16A:
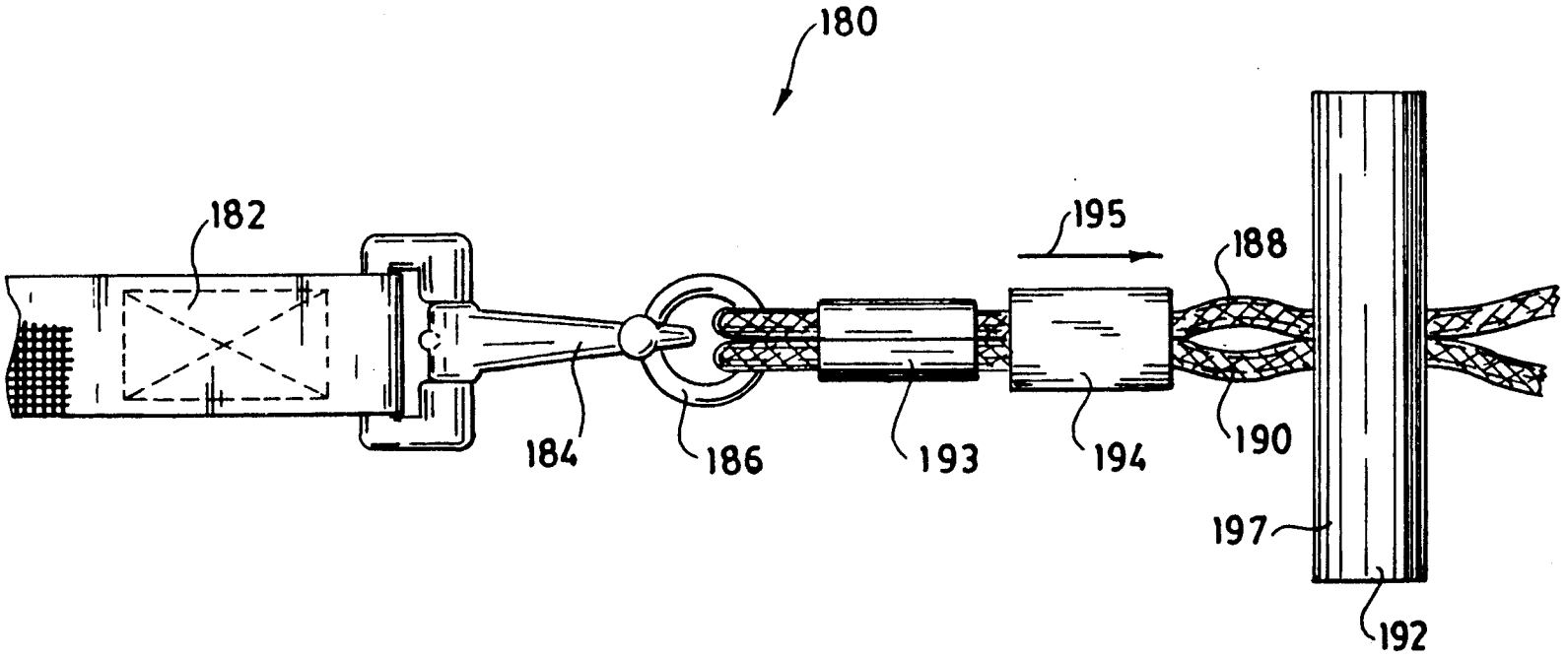

FIG. 16A illustrates a preferred connecting means 180 which may be used to connect ankle cuff 160 with block strap 170. Referring to FIG. 16A, it will be seen that leash 182 may be held in the hand(s) of a user (not shown). Leash 182 is connected to snap hook 184 which, in turn, is removably attached to steel O-ring 186. The steel O-ring 186, in turn, is attached to line cords 188 and 190 by conventional means such as, e.g., steel crimp 193 and or plastic slide tube 194. It will be appreciated by those skilled in the art that, when slide tube 194 is moved in the direction of arrow 195 toward handle 192, it ultimately will be contiguous with the the surface 197 of handle 192. In this position, it will prevent any motion of line cords 188 and 190 through the orifice in the handle 192 and will lock handle 192 into a fixed position when force is applied to such handle in the direction of arrow 195. This is illustrated in FIG. 18, which shows handle 192 locked into position against the block strap 170, thereby maintaining constant pressure against the knee joint of the user.

In one preferred embodiment, not shown, slide tube 194 is replaced with a cord lock such as, e.g., "B-LOCK 5" (described elsewhere in this specification). In another preferred embodiment, not shown, a cord lock is disposed on the other side of handle 192.

Referring again to FIG. 16A, and to the preferred embodiment illustrated therein, line cords 188 and 190 extend through an orifice (not shown) in handle 192. Thereafter, line cords 188 and 190 go through pulley blocks 110 and 112 of ankle cuff 160 (see FIG. 15), and then through the pulley blocks 110 and 112 of block strap 170, and thence back to the pulley blocks of the ankle cuff 160, to which it is then secured. It will be appreciated by those skilled in the art that a user, by pulling on either the leash 182 and/or the handle 192 (depending upon whether one is in the prone position or the sitting position) can cause movement of either the ankle cuff 160 and/or the block strap 170.

FIG. 17 illustrates the flexion device described above when the user 194 is in the prone position. It will be seen that, in this position, by pulling on leash 182, the user 194 may cause his lower leg 196 to flex.

FIG. 18 illustrates a preferred flexion device used when the user 194 is in the supine position. In this embodiment, there is a direct connection between the ankle cuff 160 and the block strap 170, two line cords (one on each side) connecting each pulley block on the ankle strap with the corresponding pulley block on the block strap. It will be seen that, when the user pulls on handle 192, he will cause his lower leg to flex back towards his upper leg.

In each of the embodiments illustrated in FIGS. 17 and 18, there are two line cords. One end of each line cord passes through a hole in the handle and then is tied or secured to each other by conventional means. The remainder of each line cord travels from the outside wheel (shive) of the pulley block of the ankle cuff, to the outside wheel of the pulley block of the block strap, to the inside wheel of the pulley block of the ankle cuff, to the inside wheel of the pulley block of the block strap, and then back to the ankle cuff, to which it is then secured by conventional means.

ANKLE/HEEL CORD FLEXION APPARATUS

Figure 19:
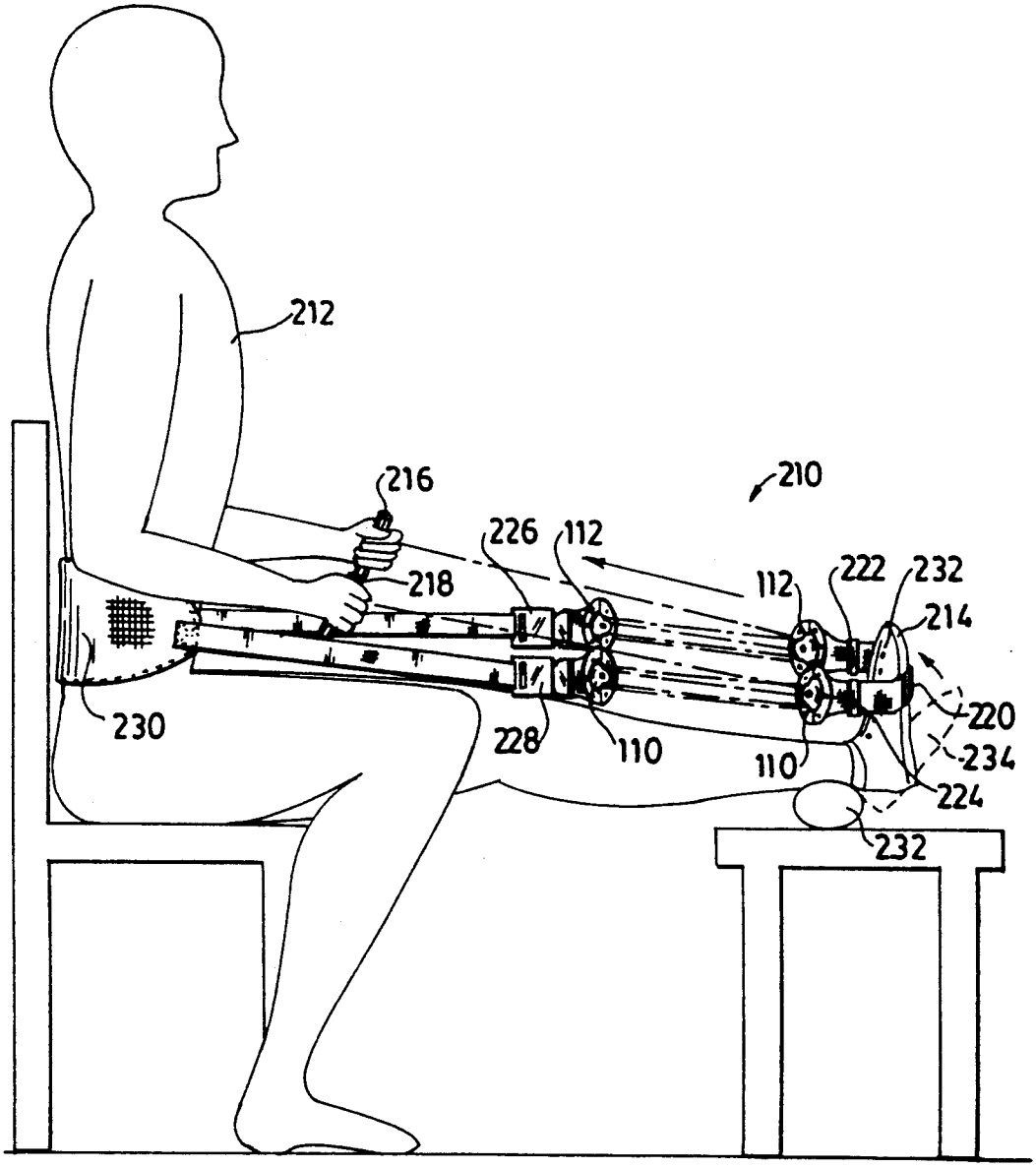
FIG. 19 is a perspective view of a patient utilizing another preferred embodiment of the invention while seated upon a chair.

FIG. 19 illustrates a preferred apparatus 210 for flexing a patient's damaged ankle and/or heel cord (the achilles tendon).

Referring to FIG. 19, patient 212 with the apparatus 210 mounted between his lower back (not shown) and his foot 214 is shown. It will be seen that apparatus 210 is comprised of handles 216 and 218, strap 220, plastic adjusters 222 and 224, buckle fasteners 226 and 228, and back sling 230. In the operation of device 210, the patient 212 may rest his leg upon a soft surface, such as pillow 232. By pulling on either handle 216 and/or 218, the patient may cause the strap to pull his foot 232 back toward him. While maintaining tension upon foot 232 by means of handles 216 and 218, the patient may then flex his foot by pulling it backward to the position shown by dotted lines 234. The patient 212 may repeat cycle of moving foot 232 back and forth under tension.

Figure 21:
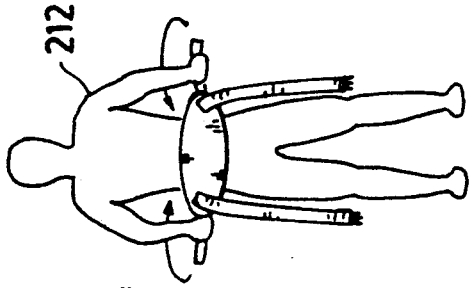
FIG. 21 illustrates a patient putting on the back sling of FIG. 20.
Figure 22:
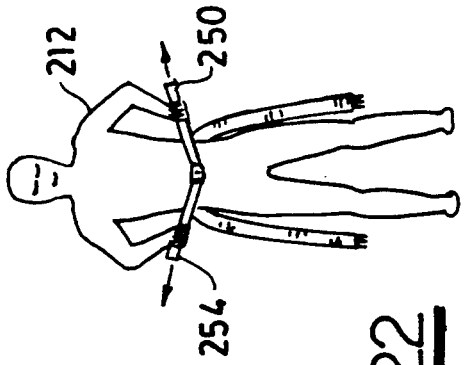
FIG. 22 illustrates a patient tightening the belt of the back sling of FIG. 20.
Figure 20:
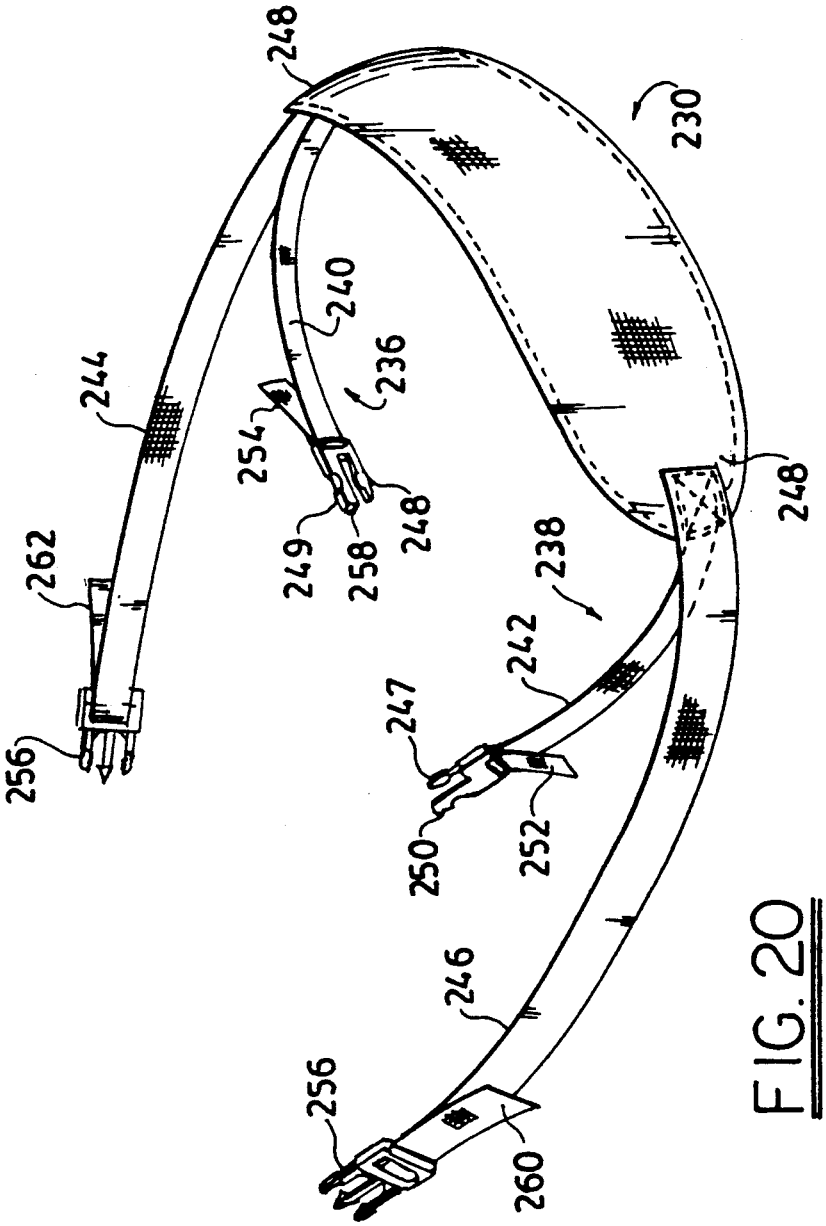
FIG. 20 is a perspective view of the back sling used in the apparatus of FIG. 19.
Figure 25:
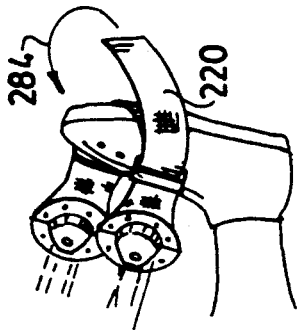
FIG. 25 illustrates a means of fastening the cuff of FIG. 24 from a patient's foot.
Figure 24:
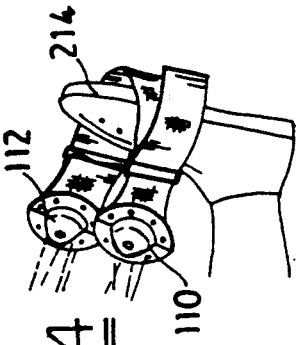
FIG. 24 perspective view of a patient's foot disposed within the cuff of the pulley system of FIG. 23.

FIG. 20 illustrates the back sling 230 used in apparatus 210. As will be seen by reference to FIGS. 21 and 22, the patient disposes back sling 230 around his lower back and, once it is so disposed, tightens sling 230 by means of buckle/strap assemblies 236 and 238.

The back sling 230 is similar in construction to block strap 170 (see FIG. 16), but it does not contain pulley blocks 110 and 112. Instead, it is attached to straps 240, 242, 244, and 246 which, in the preferred embodiment illustrated in FIG. 20, are attached to the outer surface 248 of back sling 230.

Straps 240 and 242 preferably consist of fabric such as, e.g., the nylon webbing described elsewhere in this specification. In the preferred embodiment illustrated in FIG. 20, these straps have a width of about 1.0 inch, a length of about 30 inches, and a thickness of about 0.1 inches.

Each of straps 240 and 242 has attached to its end a twin side-release "bisexual buckle" (see buckles 247 and 249) which may be purchased from the HomaLocks Inc. of 39 Shelter Rock Road, Danbury, Connecticut 06810. This "bisexual buckle" is so configured that each of its ends is adapted to engage the other end. The smaller prong 248 of each buckle is adapted to fit within an opening (not shown) in the larger prong 250 of an opposing buckle. Once to buckles have been engaged, they may be disengaged by applying pressure to one side of the engaged assembly.

Prior to or after the time the "bisexual buckles" 247 and 249 have been engaged, one may tighten the strap assembly by pulling strap end 252 and/or 254 through an opening in the open end of each buckle in order to tighten the assembly (see FIG. 22) around the patient's waist and back.

Referring again to FIG. 20, it will be seen that straps 244 and 246 are also connected to back sling 230 by conventional means (such as, e.g., sewing); the free ends of such straps are connected to side release buckles 256.

Straps 244 and 246 also may be constructed from fabric such as, e.g., nylon webbing. In the preferred embodiment illustrated in FIG. 20, each of straps 244 and 246 has a width of about 2", a length of about 36 inches, and a thickness of about 0.1 inches.

The side release buckles 256 are well known to those skilled in the art and may be purchased (as a "2" side release buckle") from the aforementioned HomaLocks, Inc. company. The male portion of these buckles is illustrated in FIG. 20; and these male portions are adapted to mate with the female portions of such buckles shown in FIG. 23.

Figure 23:
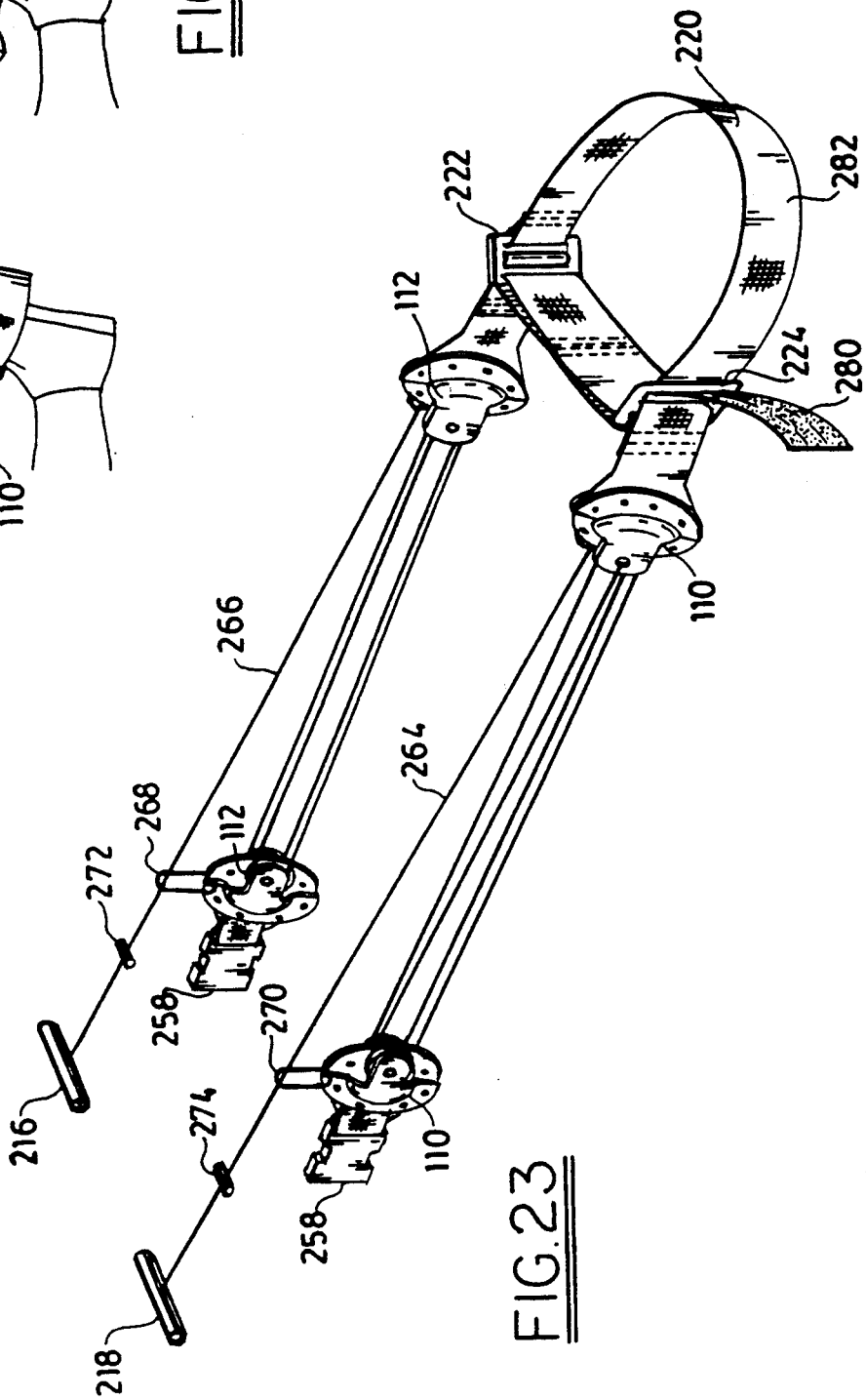
FIG. 23 is a perspective view of the pulley system of the apparatus of FIG. 19.

Referring to FIG. 23, it will be seen that the male portions of buckles 256 (not shown, but see FIG. 20) may be inserted into the female portions 258 of such buckles. Once the male and female portions are so engaged (see FIG. 19), ends 260 and 262 of straps 246 and 244 may be pulled in order to tighten the assembly (see FIG. 20).

The line cords are disposed within pulley blocks 110 and 112 in substantially the same manner as they are in the embodiment illustrated in FIGS. 17 and 18. Substantially the only significant difference is that the portion of the line cords closest to the handles 216 and 218 are caused to pass through snap rings 268 and 270, which are connected to the pulley blocks 110 and 112 closest to the handles; the use of such snap rings, which is optional, facilitates the use of cord locks 272 and 274.

One may use any conventional snap ring in the apparatus Thus, e.g., one may use a 3/16" steel snap ring which may be purchased from the Henssgen Hardware Corporation of 38 Everts Avenue, Glens Falls, N.Y.

The cord locks 272 and 274 are preferably an "ELLIPSE" cord lock which may be obtained from the aforementioned HomaLocks company. In conjunction with the snap rings 268 and 270, the allow a patient, once he has imparted the desired degree of tension to the system, to lock the system in place and maintain such tension without any further effort on his behalf.

The strap 220 is comprised of nylon webbing onto a portion of which is affixed "VELCRO" materials. When strap 220 is pulled through plastic adjuster 224 to its desired length, the hook VELCRO material 280 may be contacted with the loop VELCRO material 282 by pulling the strap in the direction of arrow 284

Figure 27:
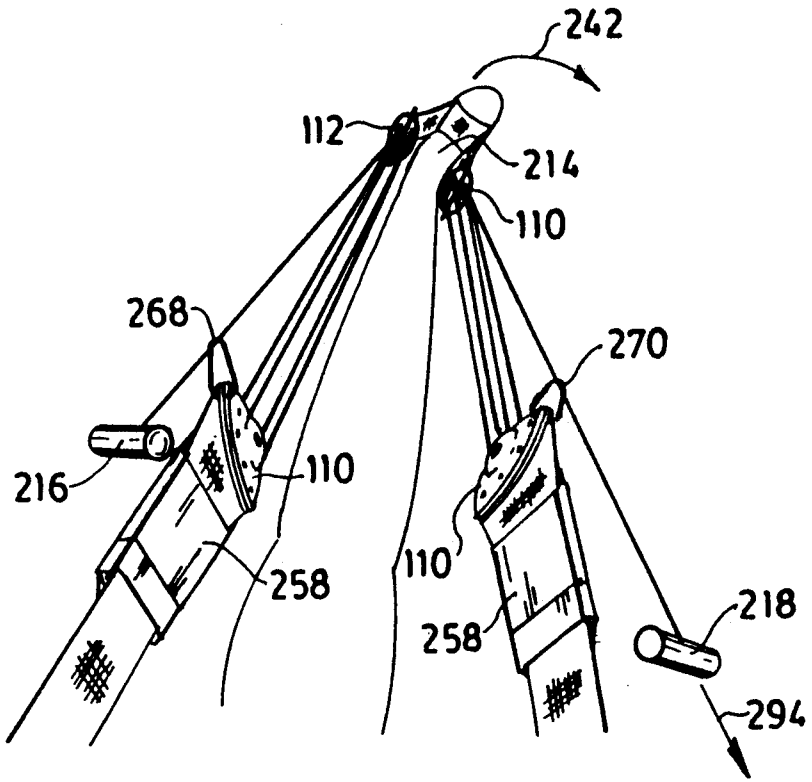
FIG. 27 illustrates one means of using the device of FIG. 19 to stretch an ankle joint.
Figure 26:
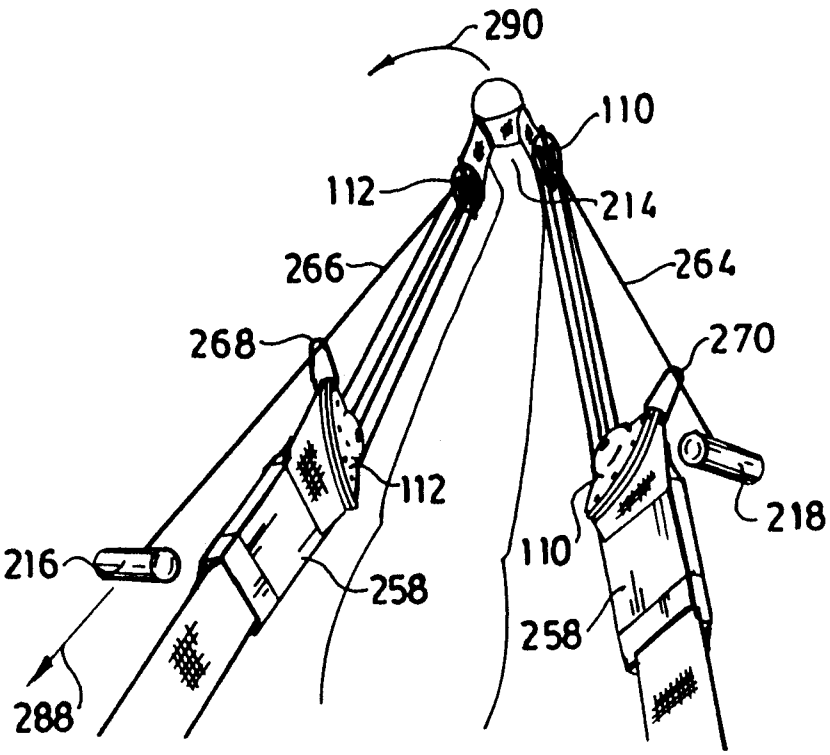
FIG. 26 illustrates one means of using the device of FIG. 19 to force an ankle joint into eversion.

In the operation of the apparatus, when each of handles 216 and 218 is pulled back an equal amount, the patient's foot 214 is pulled directly back. Referring to FIG. 26, however, if only handle 216 is pulled backwards (in the direction of arrow 288) then the patient's foot 214 will be pulled to the left, in the direction of arrow 290. Conversely, if only handle 218 is pulled backwards (in the direction of arrow 294), then the patient's foot will be pulled to the right, in the direction of arrow 292 (see FIG. 27). Thus, depending upon whether one desires inversion (turning inwardly), eversion (turning outwardly), or "dorsi-flexion" (pulling the foot straight back), one may either pull handle 218, or handle 216, or both handles.

It is to be understood that the aforementioned description is illustrative only and that changes can be made in the apparatus, and in the sequence of combinations and process steps as well as in other aspects of the invention discussed herein without departing from the scope of the invention defined in the following claims.

I claim:

1. An apparatus for flexing a foot of a human body, comprising means for grasping a foot, a first female buckle assembly, a second female buckle assembly, handle means, a first line cord and a second line cord, a first means for guiding said line cord, a second means for guiding said line cord, a third means for guiding said line cord, and a fourth means for guiding said line cord, a fifth means for guiding said line cord, a sixth means for guiding said line cord, a seventh means for guiding said line cord, an eighth means for guiding said line cord, a ninth means for guiding said line cord, and a tenth means for guiding said line cord, wherein:

(a) said means for grasping a foot is comprised of a first strap, a first pulley block attached to said first strap, and a second pulley block attached to said first strap, wherein said first pulley block is comprised of said first means for guiding said line cord and said second means for guiding said line cord, and said second pulley block is comprised of said third means for guiding said line cord and said fourth means for guiding said line cord;

(b) said first female buckle assembly is comprised of a third pulley block and a first snap ring, wherein said third pulley block is comprised of said fifth means for guiding said line cord and said sixth means for guiding said line cord, and said first snap ring is comprised of said seventh means for guiding said line cord, (c) said second female buckle assembly is comprised of a fourth pulley block and a second snap ring, wherein: said fourth pulley block is comprised of said eighth means for guiding said line cord and said ninth means for guiding said line cord, and said second snap ring is comprised of said tenth means for guiding said line cord; and (d) said first line cord extends from said means for grasping a foot to said sixth means for guiding said line cord to said second means for guiding said line cord to said fifth means for guiding said line cord to said first means for guiding said line cord to said seventh means for guiding said line cord to said handle means;

(e) said second line cord extends from said means for grasping a foot to said eighth means for guiding said line cord to said third means for guiding said line cord to said ninth means for guiding said line cord to said fourth means for guiding said line cord to said tenth means for guiding said line cord to said handle means.

2. The apparatus as recited in claim 1, wherein said apparatus is comprised of a back harness.

3. The apparatus as recited in claim 2, wherein said back harness is comprised of a sling, a second strap attached to said sling, a third strap attached to said sling, means for removably attaching said second strap to said first female buckle assembly, and means for removably attaching said third strap to said second female buckle assembly.

4. The apparatus as recited in claim 3, wherein said apparatus is comprised of a first handle attached to a first end of said line cord.

5. The apparatus as recited in claim 4, wherein said apparatus is comprised of a second handle attached to a second end of said line cord.

6. The apparatus as recited in claim 5, wherein said apparatus is comprised of a first cord lock.

7. The apparatus as recited in claim 6, wherein said first cord lock is disposed on said line cord between said first handle and said first snap ring.

8. The apparatus as recited in claim 6, wherein said apparatus is comprised of a second cord lock.

9. The apparatus as recited in claim 8, wherein said second cord lock is disposed on said line cord between said second handle and said second snap ring.

10. The apparatus as recited in claim 9, wherein said means for removably attaching said third strap to said second female buckle assembly is comprised of the male portion of a quick release buckle.

11. The apparatus as recited in claim 10, wherein said means for removably attaching said second strap to said first female buckle assembly is comprised of the male portion of a quick release buckle.

12. The apparatus as recited in claim 11, wherein said first strap is comprised of fabric means for removably fastening one portion of said first strap to another portion of said first strap.

13. The apparatus as recited in claim 12, wherein said back harness is comprised of a fourth strap attached to said sling and a fifth strap attached to said sling.

14. The apparatus as recited in claim 13, wherein said apparatus is comprised of means for removably attaching said fourth strap to said fifth strap.

15. The apparatus as recited in claim 14, wherein each of said second strap and said third strap is comprised of means for adjusting the distance between said back sling and said means for grasping a foot.

16. The apparatus as recited in claim 15, wherein each of said fourth strap and said fifth strap is comprised of adjustable means for attaching said back sling to the trunk of the patient.

* * * * *